US008196665B2

(12) United States Patent
Wolinsky

(10) Patent No.: US 8,196,665 B2
(45) Date of Patent: Jun. 12, 2012

(54) METHOD AND APPARATUS FOR CONTAINING AN OIL SPILL CAUSED BY A SUBSEA BLOWOUT

(75) Inventor: Scott Wolinsky, Sewell, NJ (US)

(73) Assignee: Subsea IP Holdings LLC, Sewell, NJ (US)

( * ) Notice: Subject to any disclaimer, the term of this patent is extended or adjusted under 35 U.S.C. 154(b) by 0 days.

(21) Appl. No.: 12/842,475

(22) Filed: Jul. 23, 2010

(65) Prior Publication Data

US 2011/0315394 A1 Dec. 29, 2011

Related U.S. Application Data

(63) Continuation of application No. 12/822,324, filed on Jun. 24, 2010.

(51) Int. Cl.
*E21B 33/06* (2006.01)

(52) U.S. Cl. ..... 166/356; 166/363; 405/60; 405/210

(58) Field of Classification Search ..... 166/356, 166/363, 364, 368, 277, 177.4, 90.1, 97.1, 166/165; 405/52, 60, 203, 205, 210, 53, 405/55, 224.1; 52/169.6, 169.7, 169.8; 210/922
See application file for complete search history.

(56) References Cited

U.S. PATENT DOCUMENTS 2,589,153 A 3/1952 Smith
3,063,500 A * 11/1962 Logan ..... 166/351
3,568,737 A 3/1971 Burns
3,686,877 A * 8/1972 Bodin ..... 405/8
3,824,942 A * 7/1974 Stafford et al. ..... 405/210
3,864,924 A * 2/1975 Piotin ..... 405/188
3,965,688 A 6/1976 Jensen
4,108,318 A 8/1978 Rode et al.
4,193,455 A 3/1980 Steddum et al.
4,283,159 A * 8/1981 Johnson et al. ..... 405/60
4,324,505 A * 4/1982 Hammett ..... 405/60
4,358,218 A * 11/1982 Graham ..... 405/60
4,558,744 A 12/1985 Gibb
4,630,680 A 12/1986 Elkins (Continued)

OTHER PUBLICATIONS

"Caisson (engineering)," Wikipedia, the free encyclopedia, available at http://en.wikipedia.org/wiki/Caisson_(engineering)#Types (last modified on Jul. 15, 2010 and last visited on Aug. 3, 2010).

(Continued)

*Primary Examiner* — David Bagnell
*Assistant Examiner* — Sean Andrish
(74) *Attorney, Agent, or Firm* — Volpe and Koenig, P.C.

(57) ABSTRACT

A method and apparatus are described for containing an oil spill caused by a subsea blowout, (i.e., a source of pollution located on a floor of an ocean, (e.g., a defective blowout preventer (BOP) that caused the oil spill)). A cylindrical containment assembly may be positioned such that a wall of the cylindrical containment assembly circumvents a portion of a floor of an ocean where the subsea blowout occurred. At least one mud flap may be configured to selectively protrude from the wall or retract into the wall when activated to control the depth that the cylindrical containment assembly sinks to below the ocean floor. A valve assembly may be positioned on the top perimeter of the wall. The top perimeter of the wall may have the same diameter as the outer perimeter of the valve assembly.

11 Claims, 22 Drawing Sheets

U.S. PATENT DOCUMENTS

| | | | | |
|---|---|---|---|---|
| 4,664,556 | A | 5/1987 | Dixon | |
| 4,880,060 | A | 11/1989 | Schwendemann et al. | |
| 5,259,458 | A | 11/1993 | Schaefer, Jr. et al. | |
| 5,356,241 | A | 10/1994 | Kunito | |
| 5,460,728 | A | 10/1995 | Klomp et al. | |
| 5,554,218 | A | 9/1996 | Evans et al. | |
| 5,706,897 | A | 1/1998 | Horton, III | |
| 5,803,659 | A | 9/1998 | Chattey | |
| 5,873,416 | A | 2/1999 | Horton, III | |
| 5,881,815 | A | 3/1999 | Horton, III | |
| 6,179,057 | B1 | 1/2001 | Fontana et al. | |
| 6,601,649 | B2 | 8/2003 | Beato et al. | |
| 7,021,402 | B2 | 4/2006 | Beato et al. | |
| 7,051,804 | B1 | 5/2006 | Arning | |
| 7,264,067 | B2 | 9/2007 | Glaser et al. | |
| 7,703,534 | B2 | 4/2010 | Sheshtawy | |
| 7,706,980 | B2 | 4/2010 | Winters et al. | |
| 7,757,772 | B2 | 7/2010 | Donohue et al. | |
| 2008/0135258 | A1* | 6/2008 | Daniel et al. | 166/363 |
| 2009/0107387 | A1* | 4/2009 | Horton, III | 114/295 |

OTHER PUBLICATIONS

"Catching a Wave: Jet Flow Gate Testing Brings a Crowd," Bureau of Reclamation: Lower Colorado Region—Hoover Dam: Jet Flow available at http://www.usbr.gov/lc/hooverdam/History/essays/jetflow.html (last reviewed Sep. 8, 2004 and last visited Aug. 3, 2010).

"Deepwater Horizon oil spill," Wikipedia, the free encyclopedia available at http://en.wikipedia.org/wiki/Deepwater_Horizon_oil_spill (last modified on Aug. 3, 2010 and last visited Aug. 3, 2010).

Guarino, "What is 'top kill' and when will we know if it plugs BP oil spill?" The Christian Science Monitor available at http://www.csmonitor.com/USA/2010/0526/What-is-top-kill-and-when-will-we-know-if-it-plugs-BP-oil-spill (May 26, 2010) (last visited Aug. 3, 2010).

Hanna, "How BP's 'top kill' procedure will work," CNN.com available at http://www.cnn.com/2010/US/05/24/faq.top.kill.bp/index.html (May 24, 2010) (last visited Aug. 3, 2010).

Meinhold, "First Oil Containment Dome Shipped to Deepwater Horizon Spill," Inhabitant.com available at http://inhabitat.com/2010/05/05/first-oil-containment-dome-shipped-to-deepwater-horizon-spill (May 5, 2010) (last visited Aug. 3, 2010).

Rhodes, "Blame Big Bad B.P. For Now, but Where Is the Next Oil to Come From?," Scitizen available at http://scitizen.com/future-energies/blame-big-bad-b-p-for-now-but-where-is-the-next-oil-to-come-from-_a-14-3508.html (Jun. 22, 2010) (last visited Aug. 3, 2010).

Ryden, "Methane Gas Hydrates causing problems for capping oil leak," Global Warming Examiner available at http://www.examiner.com/x-325-Global-Warming-Examiner~y2010m5d8-Methane-Gas-Hydrates-causing-problems-for-capping-oil-leak (May 8, 2010) (last visited Aug. 3, 2010).

Walker, "Method for containing subsea oil blowouts," Tech Briefs available at http://contest.techbriefs.com/component/content/article/329 (May 1, 2010) (last visited Aug. 3, 2010).

* cited by examiner

METHOD AND APPARATUS FOR CONTAINING AN OIL SPILL CAUSED BY A SUBSEA BLOWOUT

CROSS REFERENCE TO RELATED APPLICATIONS

This application is a continuation of U.S. patent application Ser. No. 12/822,324, filed Jun. 24, 2010, which is incorporated by reference as if fully set forth herein.

TECHNICAL FIELD

This application generally relates to a method and apparatus for containing an oil and/or gas spill originating from the bottom of an ocean.

BACKGROUND

An offshore platform, often referred to as an oil platform or an oil rig, is a large structure used in offshore drilling to house workers and machinery needed to drill wells in the ocean bed, extract oil and/or natural gas, process the produced fluids, and ship or pipe them to shore. Depending on the circumstances, the platform may be fixed to the ocean floor, may consist of an artificial island, or may float.

Remote subsea wells may also be connected to a platform by flow lines and by umbilical connections. These subsea solutions may consist of single wells or of a manifold center for multiple wells.

FIG. 1 shows a deep sea drilling rig 100 on an ocean surface 105 that processes oil and/or gas 110 obtained from below an ocean floor 115 via a blowout preventer (BOP) stack 120 and a riser assembly 125.

FIG. 2 illustrates a deep sea drilling rig 100' after exploding due to a defective BOP stack 120', causing an oil and/or gas spill 210 that pollutes the ocean and needs to be contained. The explosion may further cause the riser assembly 125 to break into portions 125' and 125".

The Deepwater Horizon oil spill, also called the BP oil spill, the Gulf of Mexico oil spill or the Macondo blowout, was a massive oil spill in the Gulf of Mexico, and is considered the largest offshore spill to ever occur in U.S. history. The spill stemmed from a sea floor oil gusher that started with an oil well blowout on Apr. 20, 2010. The blowout caused a catastrophic explosion on the Deepwater Horizon offshore oil drilling platform that was situated about 40 miles (64 km) southeast of the Louisiana coast in the Macondo Prospect oil field. The explosion killed 11 platform workers and injured 17 others. Another 98 people survived without serious physical injury.

Although numerous crews worked to block off bays and estuaries, using anchored barriers, floating containment booms, and sand-filled barricades along shorelines, the oil spill resulted in an environmental disaster characterized by petroleum toxicity and oxygen depletion, thus damaging the Gulf of Mexico fishing industry, the Gulf Coast tourism industry, and the habitat of hundreds of bird species, fish and other wildlife. A variety of ongoing efforts, both short and long term, were made to contain the leak and stop spilling additional oil into the Gulf, without immediate success.

After the Deepwater Horizon drilling rig explosion on Apr. 20, 2010, a BOP should have activated itself automatically to avoid an oil spill in the Gulf of Mexico. The oil spill originated from a deepwater oil well 5,000 feet (1,500 m) below the ocean surface. A BOP is a large valve that has a variety of ways to choke off the flow of oil from a gushing oil well. If underground pressure forces oil or gas into the wellbore, operators can close the valve remotely (usually via hydraulic actuators) to forestall a blowout, and regain control of the wellbore. Once this is accomplished, often the drilling mud density within the hole can be increased until adequate fluid pressure is placed on the influx zone, and the BOP can be opened for operations to resume. The purpose of BOPs is to end oil gushers, which are dangerous and costly.

Underwater robots were sent to manually activate the Deepwater Horizon's BOP without success. BP representatives suggested that the BOP may have suffered a hydraulic leak. However, X-ray imaging of the BOP showed that the BOP's internal valves were partially closed and were restricting the flow of oil. Whether the valves closed automatically during the explosion or were shut manually by remotely operated vehicle work is unknown.

BOPs come in a variety of styles, sizes and pressure ratings, and usually several individual units compose a BOP stack. The BOP stack used for the Deepwater Horizon is quite large, consisting of a five-story-tall, 300-ton series of oil well control devices.

The amount of oil that was discharged after the Deepwater Horizon drilling rig explosion is estimated to have ranged from 12,000 to 100,000 barrels (500,000 to 4,200,000 gallons) per day. The volume of oil flowing from the blown-out well was estimated at 12,000 to 19,000 barrels (500,000 to 800,000 gallons) per day, which had amounted to between 440,000 and 700,000 barrels (18,000,000 and 29,000,000 gallons). In any case, an oil slick resulted that covered a surface area of over 2,500 square miles (6,500 $km^2$). Scientists had also discovered immense underwater plumes of oil not visible from the surface.

Various solutions have been attempted to control or stop an undersea oil and/or gas spill. One solution is to use a heavy (e.g., over 100 tons) container dome over an oil well leak and pipe the oil to a storage vessel on the ocean surface. However, this solution has failed in the past due to hydrate crystals, which form when gas combines with cold water, blocking up a steel canopy at the top of the dome. Thus, excess buoyancy of the crystals clogged the opening at the top of the dome where the riser was to be connected.

Another solution is to attempt to shut down the well completely using a technique called "top kill". This solution involves pumping heavy drilling fluids into the defective BOP, causing the flow of oil from the well to be restricted, which then may be sealed permanently with cement. However, this solution has not been successful in the past.

It would be desirable to have a method and apparatus readily available to successfully contain oil and/or gas spewing from a defective BOP stack, until an alternate means is made available to permanently cap or bypass the oil and/or gas spill, or to repair/replace the defective BOP stack.

SUMMARY

A method and apparatus are described for containing an oil spill caused by a subsea blowout. A cylindrical containment assembly may be positioned such that a wall of the cylindrical containment assembly circumvents a portion of a floor of an ocean where the subsea blowout occurred. Further, a source of pollution located on a floor of an ocean, (e.g., a defective blowout preventer (BOP) that caused an oil spill), may be encased by positioning a containment wall to circumvent the source of pollution.

The cylindrical containment assembly may form a watertight seal with the ocean floor. At least one mud flap may be configured to selectively protrude from the wall or retract into the wall when activated to control the depth that the cylindrical containment assembly sinks to below the ocean floor.

A valve assembly may be positioned on a top perimeter of the wall. The top perimeter of the wall may have the same diameter as the outer perimeter of the valve assembly.

BRIEF DESCRIPTION OF THE DRAWINGS

A more detailed understanding may be had from the following description, given by way of example in conjunction with the accompanying drawings wherein.

DETAILED DESCRIPTION

The present invention described herein proposes the undertaking of a potentially expensive method and apparatus, due to the substantially large size of a defective BOP stack that must be circumvented and sealed under thousands of feet of water in response to a catastrophic event, such as the Deepwater Horizon oil spill. However, it has recently been discovered that there are currently no procedures or apparatus available for effectively dealing with such events, and that the consequences of other similar events occurring over a period of time have the potential to destroy life on Earth as we know it.

Instead of tapping off various points of the defective BOP stack 120', the present invention uses its various embodiments to substantially isolate the BOP stack 120' from the ocean by completely circumventing and encasing the defective BOP stack 120'. Thus, the amount of ocean that mixes with the spewing oil and/or gas 210 is minimized. Furthermore, a combination of one or more heating elements and measurement equipment, as well as the addition of one or more valves, allow the present invention to better contain and/or control the spewing oil and/or gas 210.

The present invention proposes a method and apparatus for containing oil from a subsea oil and/or gas blowout. An apparatus constructed from this design will mitigate the spread of oil slicks from subsea oil and/or gas blowouts, with the benefit of allowing oil and/or gas exploration to proceed with diminished risk of environmental damage. The present invention has particular application where coastal wetlands or other delicate ecosystems may potentially be damaged by an oil spill. There currently appears to be no alternative method or apparatus for containing the oil from such blowouts. The present invention has market potential in basins subject to offshore oil exploration where deepwater rigs are active.

The reinforcement material mentioned herein, such as cement, is used underwater for many purposes including, for example, in pools, dams, piers, retaining walls and tunnels. There are many factors that must be controlled for successful application of cement underwater. Of these, the hardening time, that between mixing and solidification, is particularly important because, if it is too long, the cement does not solidify at all but simply dissolves in the surrounding water, herein the environmental water. Compositions containing exothermic micro particles have been found very advantageous for underwater cement applications. The exothermic micro particles produce very high rates of exothermic heating when combined with base cement and water. The exothermic heat produced is sufficient to raise the reaction temperature to a point where the cement composition solidifies underwater, even in cold environmental water.

Figure 3A:
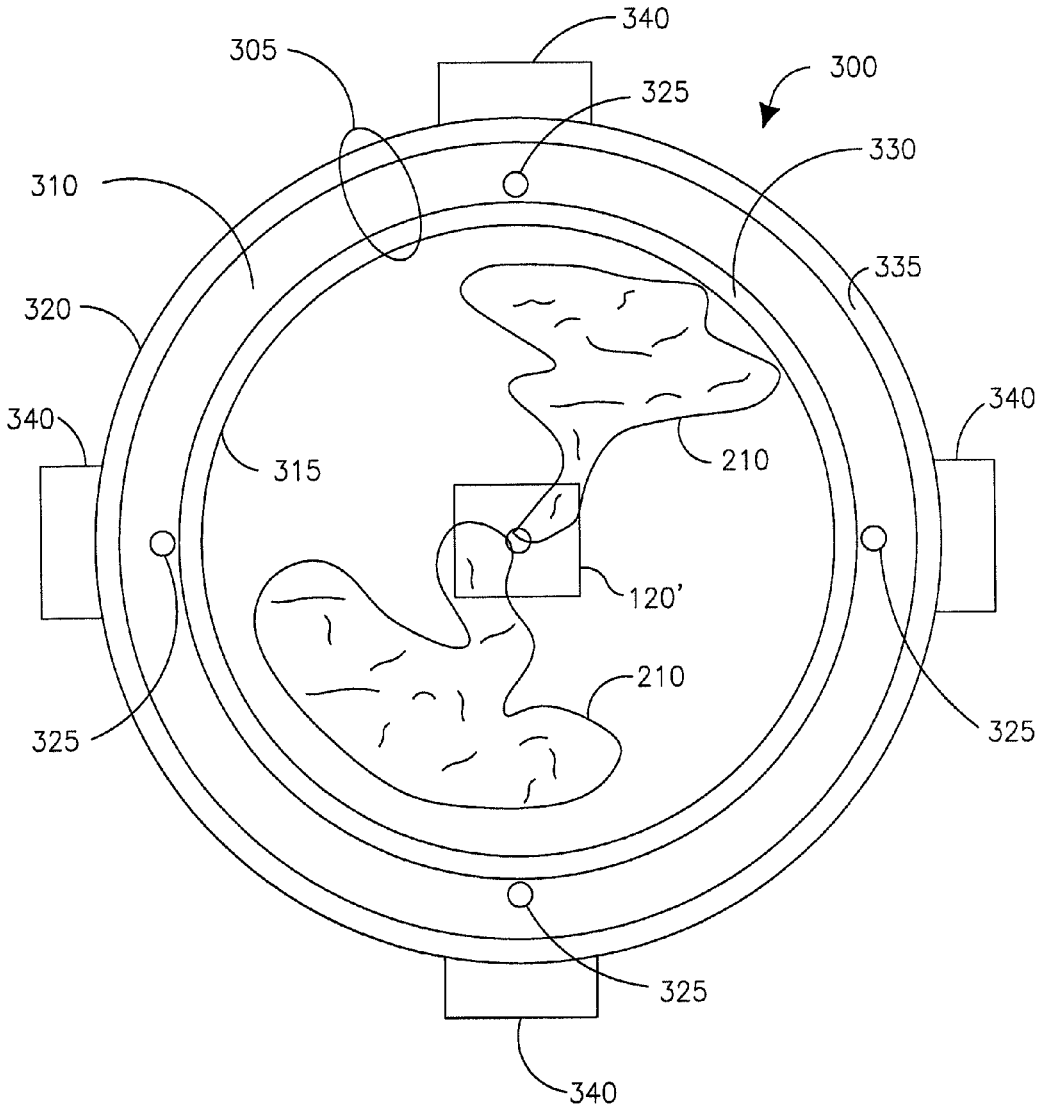
FIG. 3A shows a top view of a cylindrical containment assembly that is configured in accordance with a first embodiment of the present invention.

FIG. 3A shows a top view of a cylindrical containment assembly 300 in accordance with a first embodiment of the present invention. The cylindrical containment assembly 300 has a wide hollow wall 305 comprising a reinforcement cavity 310 between an inner wall 315 and an outer wall 320, as well as a set of input valves 325 located near the top perimeter 328 (see FIG. 3D) of the wide hollow wall 305 for filling the reinforcement cavity 310 with reinforcement material (e.g., cement). The inner wall 315 and the outer wall 320 may be steel-reinforced, or consist of any other metal of a suitable strength and thickness. The cylindrical containment assembly 300 further comprises at least one seal (e.g., an inner seal 330 and an outer seal 335) that is mounted along the entire top perimeter 328 (see FIG. 3D) of the wide hollow wall 305 of the cylindrical containment assembly 300. Optionally, the cylindrical containment assembly 300 may include one or more mud flaps 340 to stop the cylindrical containment assembly 300 from sinking too far below the ocean floor 115, especially after the reinforcement cavity 310 is filled with reinforcement material.

A more sophisticated system of mud flaps 340 may be implemented, whereby the mud flaps 340 may be located at different heights along the outer wall 320 of the cylindrical containment assembly 300, and may be remotely activated (either wirelessly or via a wired or hydraulic connection from a vessel on the ocean surface 105) to protrude or retract, or be raised or lowered, to control the depth of the cylindrical containment assembly 300 as more weight is added on top of it in order to contain the spewing oil and/or gas 210. Furthermore, the mud flaps 340 may be designed to break off, based on how much weight is applied to the top perimeter 328 (see FIG. 3D) of the wide hollow wall 305 of the cylindrical containment assembly 300.

The cylindrical containment assembly 300 is lowered below the ocean surface 105 and positioned on a portion of the ocean floor 115 that circumvents the defective BOP stack 120'. Although it may be possible to lower the cylindrical containment assembly 300 over the defective BOP stack 120' if the riser assembly 125 remains in a vertical position by letting the riser assembly 125 pass through the center of the cylindrical containment assembly 300, the riser assembly 125 needs to be disconnected (i.e., cut off) near the top of the defective BOP stack 120' if a catastrophic event caused the riser assembly 125 to collapse (i.e., fold over), as what occurred due to the Deepwater Horizon drilling rig explosion (see FIG. 2).

Alternatively, the cylindrical containment assembly 300 may consist of a plurality of sections and/or components that are assembled below the ocean surface 105. The sections and/or components of the cylindrical containment assembly 300 would be constructed and stored onshore close to areas where deepwater rigs are active. The sections and/or components may include seals and/or gaskets, and the sections and/or components may be assembled together as they are immersed just under the ocean surface 105.

Figure 3B:
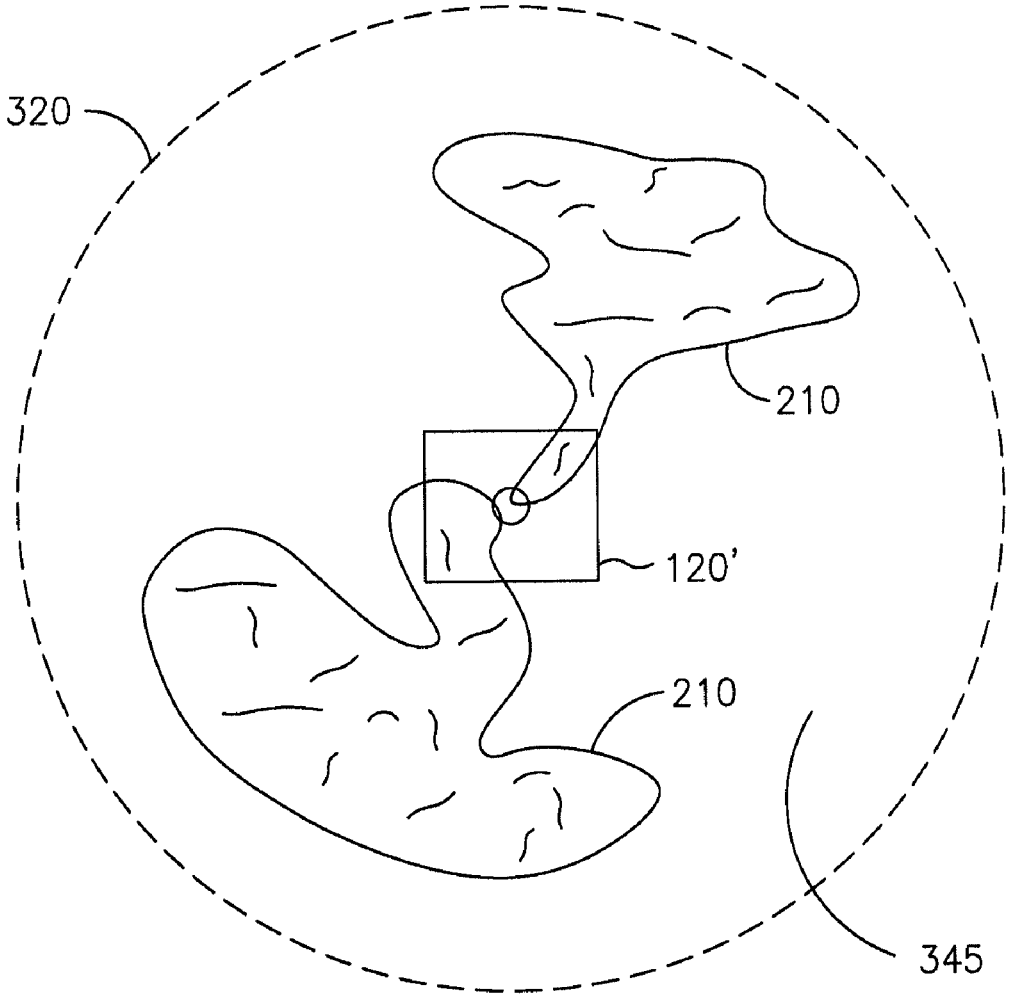
FIG. 3B shows a top view of the defective BOP stack and an outline of the outer wall of the cylindrical containment assembly of FIG. 3A circumventing the defective BOP stack on a portion of the ocean floor.

FIG. 3B shows a top view of the defective BOP stack 120' and a portion 345 of the ocean floor 115 that the cylindrical containment assembly 300 is to be positioned on to circumvent the defective BOP stack 120'. It would be desirable to grade the portion 345 of the ocean floor 115 surrounding the defective BOP stack 120', and that is to be circumvented by the outer wall 320 of the cylindrical containment assembly 300, before the cylindrical containment assembly 300 is positioned on it, in order to optimize the reduction of the pollution of the ocean caused by the oil and/or gas 210 spewing from the defective BOP stack 120'. Such ocean floor grading may be performed by at least one remotely operated vehicle (ROV). Furthermore, the ROV may be used to assist in the lowering and positioning of the cylindrical containment assembly 300.

Figure 3C:
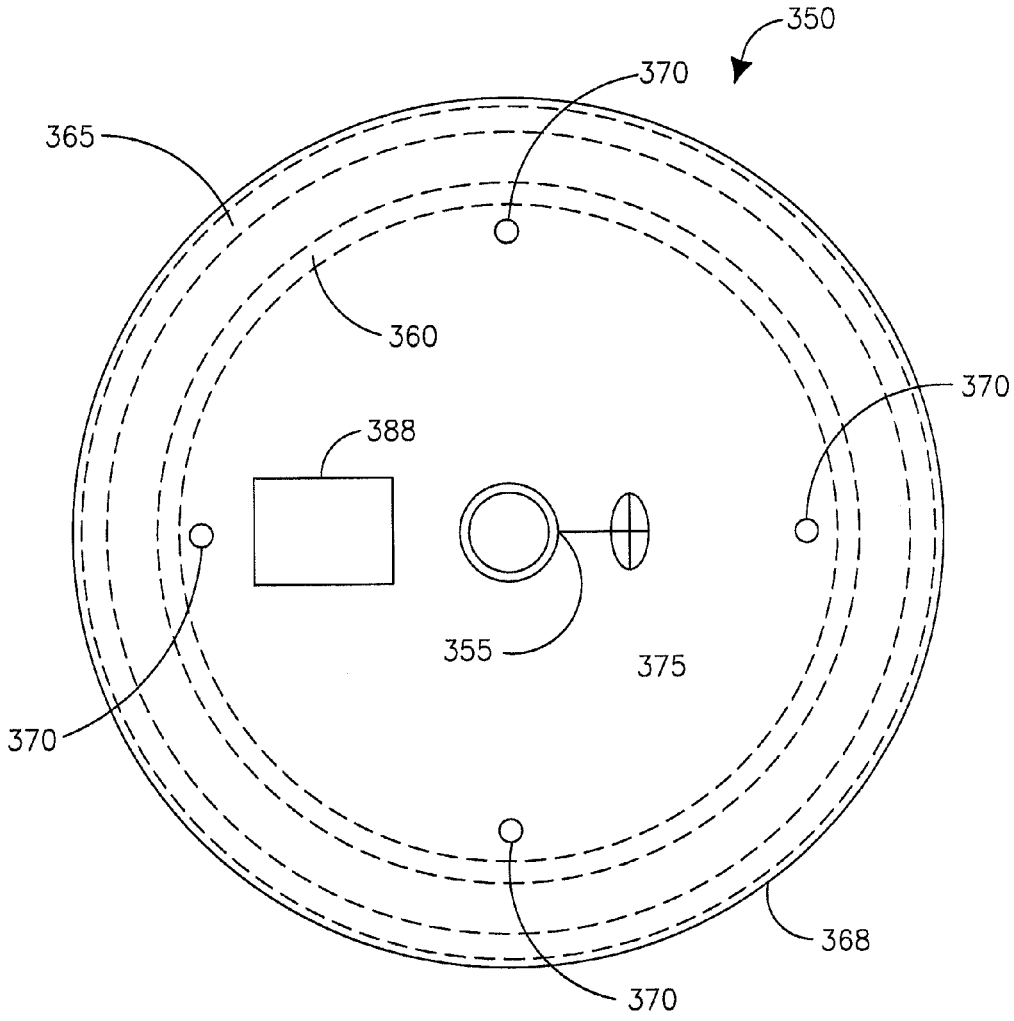
FIG. 3C shows a top view of a cylindrical valve assembly having at least one large diameter valve that is configured to be used in combination with the cylindrical containment assembly of FIG. 3A.

FIG. 3C shows a top view of a cylindrical valve assembly 350 that is preferably at least the same diameter as the cylindrical containment assembly 300 of FIG. 3A. The cylindrical valve assembly 350 comprises at least one large diameter valve 355, at least one seal (e.g., an inner seal 360 and an outer seal 365) that is mounted along the entire bottom perimeter 368 of the cylindrical valve assembly 350, as well as a set of input valves 370 that surround the valve 355 for filling a hollow cavity 375 of the cylindrical valve assembly 350 with reinforcement material (e.g., cement). In its open position, the valve 355 is configured with an opening of such a large diameter that the spewing oil and/or gas 210 would pass through it without being sufficiently impeded by ice-like crystals (i.e., icy hydrates) that may form near the bottom of an ocean.

Figure 3D:
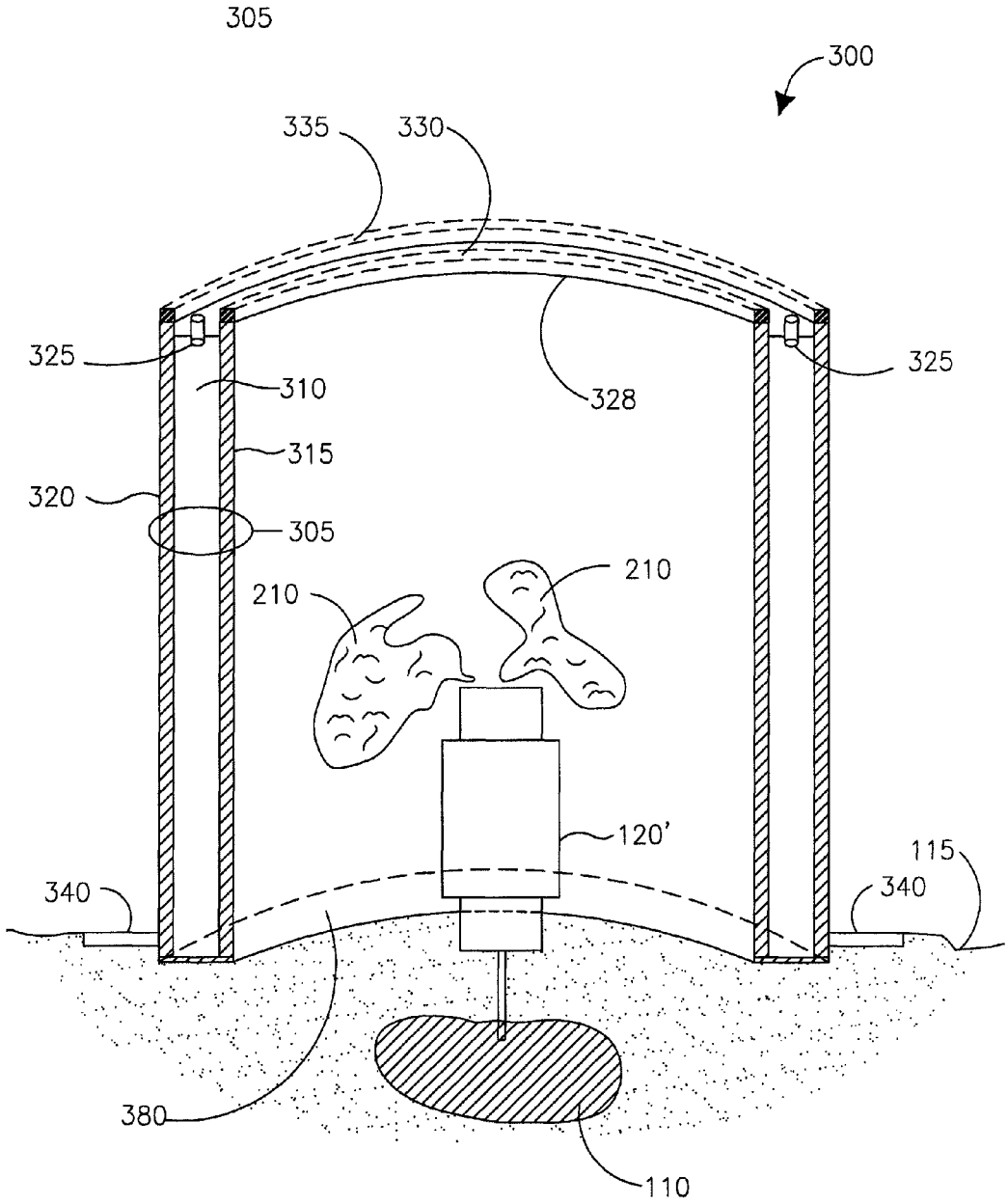
FIG. 3D shows a schematic view of the cylindrical containment assembly of FIG. 3A.

FIG. 3D shows a schematic view of the wide hollow wall 305 of the cylindrical containment assembly 300, whereby it can be seen that the wide hollow wall 305 further comprises an annular rim 380 connecting the bottom of the inner wall 315 to the bottom of the outer wall 320.

Figure 3E:
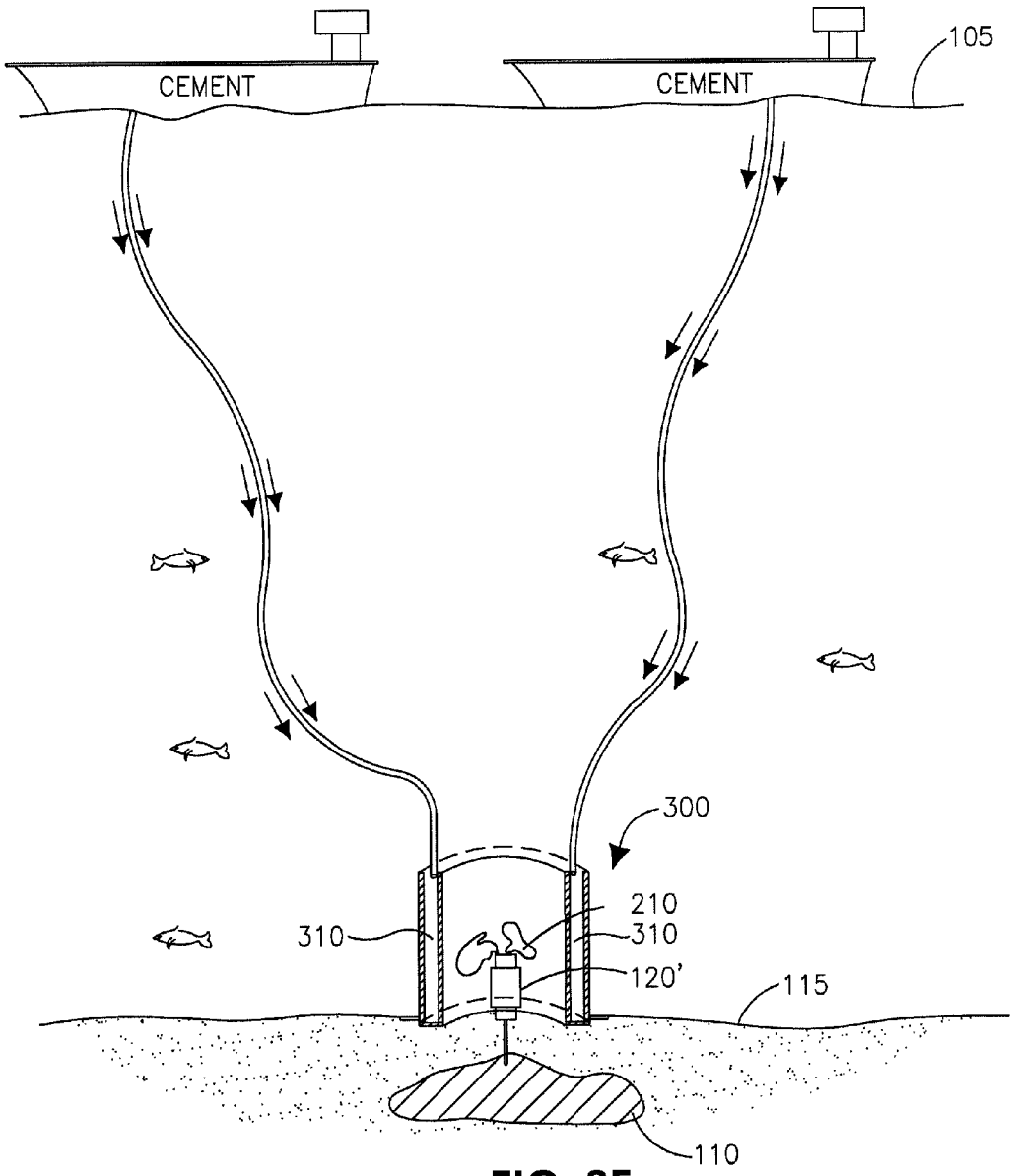
FIG. 3E shows a schematic view of a reinforcement cavity of the cylindrical containment assembly of FIGS. 3A and 3D being filled with reinforcement material (e.g., cement)

FIG. 3E shows a schematic view of the reinforcement cavity 310 (above the annular rim 380 of the cylindrical containment assembly 300) being filled with reinforcement material (e.g., cement). The advantage of the present invention is that extraordinary bulk and strength that is required to contain the pressure encountered under the ocean due to the spewing oil and/or gas may be added later after the components of a relatively enormous oil/gas containment structure are transported and positioned on the ocean floor 115.

Figure 3F:
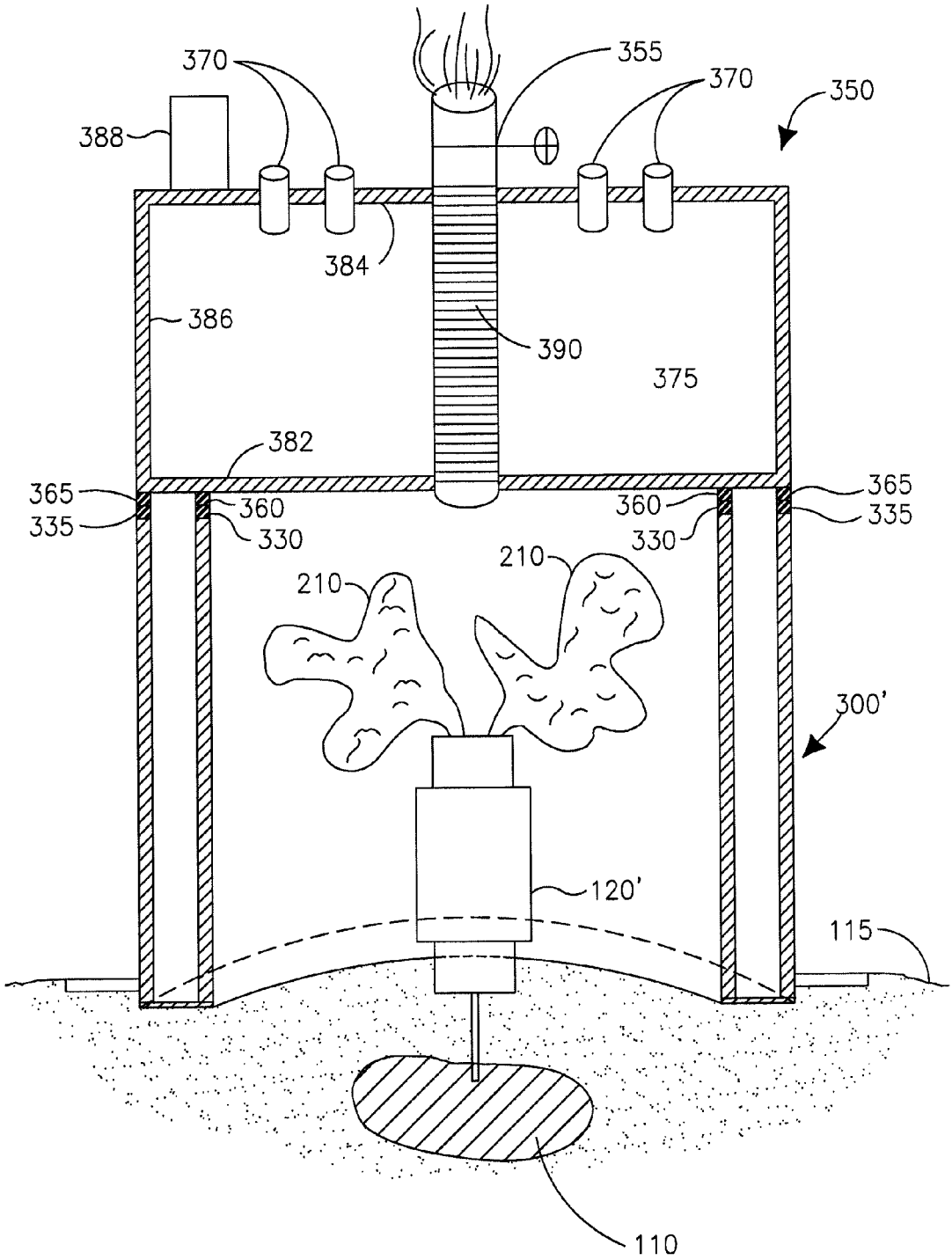
FIG. 3F shows a schematic view of the cylindrical valve assembly of FIG. 3C resting on top of the reinforced cylindrical containment assembly.

FIG. 3F shows a schematic view of the cylindrical valve assembly 350 of FIG. 3C resting on top of the cylindrical containment assembly 300 of FIG. 3A after it is reinforced (hereinafter referred to as the reinforced cylindrical containment assembly 300'). The hollow cavity 375 of the cylindrical valve assembly 350 comprises a floor 382, a ceiling 384 and a wall 386. The at least one large diameter valve 355 protrudes through the ceiling 384 and the floor 382 of the hollow cavity 375. The floor 382, ceiling 384 and wall 386 of the hollow cavity 375 of the cylindrical valve assembly 350 may be steel-reinforced, or consist of any other metal of a suitable strength and thickness. Optionally, the cylindrical valve assembly 350 may further comprise a pressure monitor unit 388 for monitoring the pressure of the oil and/or gas contained within the reinforced cylindrical containment assembly 300', and one or more heating elements 390 for heating up the large diameter valve 355. Preferably, the valve 355 and the heating elements 390 may be configured to be remotely activated (either wirelessly or via a wired or hydraulic connection from a vessel on the ocean surface 105).

When the cylindrical valve assembly 350 is lowered below the ocean surface 105 onto the reinforced cylindrical containment assembly 300', the valve 355 is maintained in a fully open position such that the oil and/or gas 210 spewing from the defective BOP stack 120' is allowed to pass through the valve 355. By leaving at least one valve 355 of a suitable diameter in a fully open position, buoyancy problems due to the pressure of the spewing oil and/or gas 210 may be minimized, while the hollow cavity 375 of the cylindrical valve assembly 350, surrounding the valve 355, is filled with reinforcement material (e.g., cement). Preferably, the valve 355 may be configured to be remotely controlled (either wirelessly or via a wired or hydraulic connection from a vessel on the ocean surface 105) to maintain an open position, a partially open position or a closed position, as desired. A ROV may be used to assist in the lowering and positioning of the cylindrical valve assembly 350.

Figure 3G:
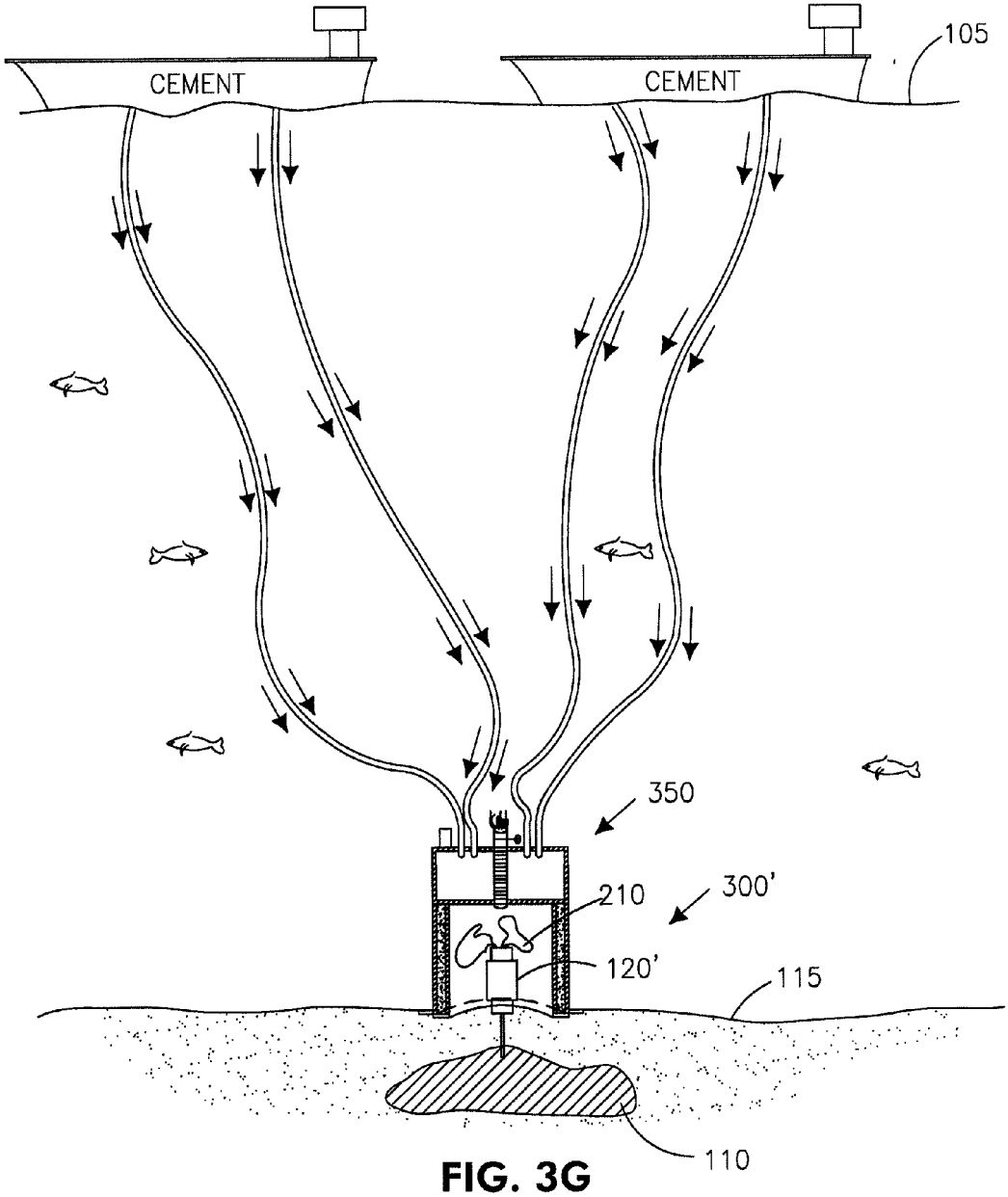
FIG. 3G shows a schematic view of a hollow cavity that surrounds the large diameter valve of the cylindrical valve assembly of FIGS. 3C and 3F being filled with reinforcement material (e.g., cement)

FIG. 3G shows a schematic view of the hollow cavity 375 of the cylindrical valve assembly 350 being filled with reinforcement material (e.g., cement).

Figure 3H:
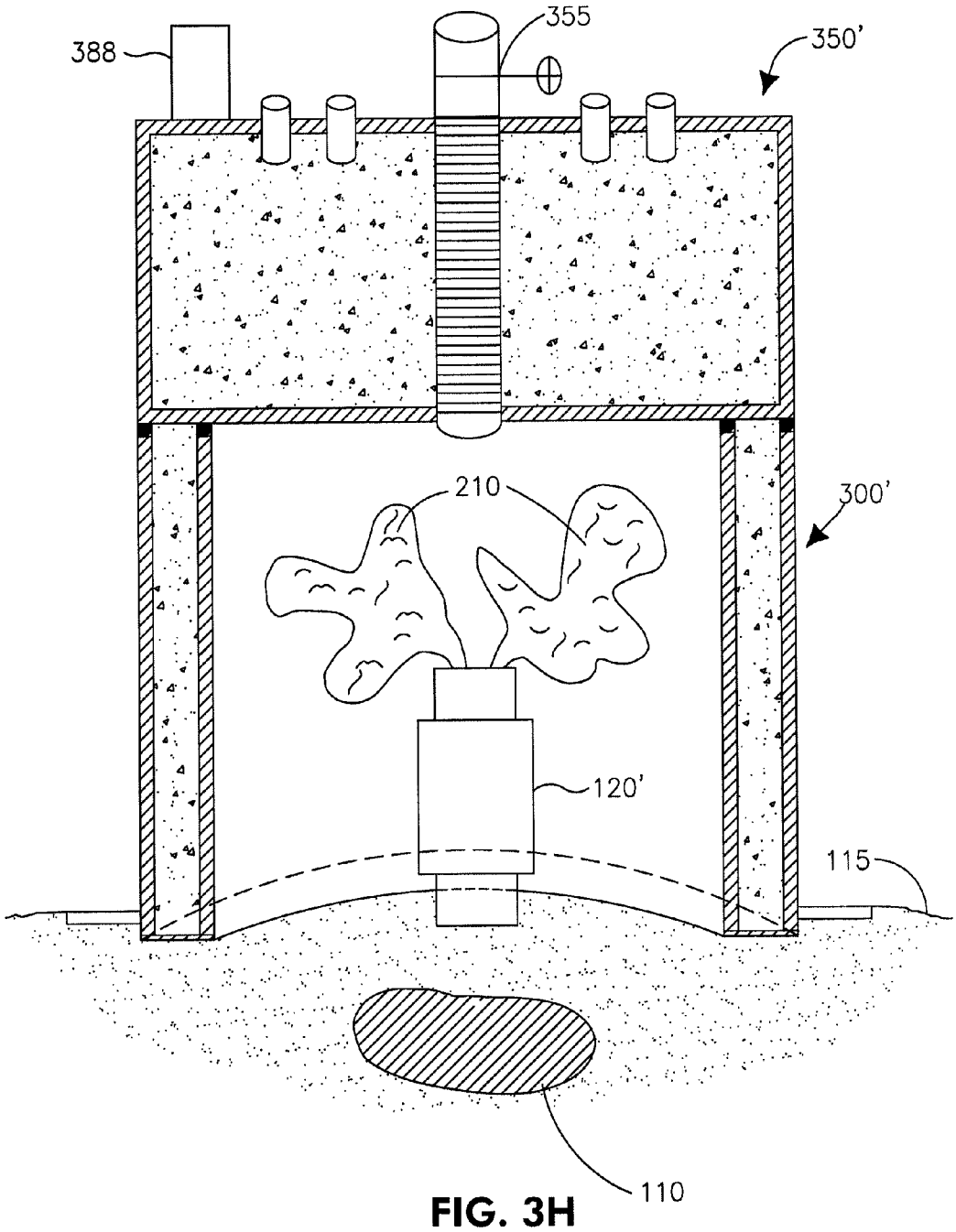
FIG. 3H shows a schematic view of the reinforced cylindrical valve assembly, after the large diameter valve has been closed, resting on the reinforced cylindrical containment assembly in accordance with the first embodiment of the present invention.

FIG. 3H shows a schematic view of the cylindrical valve assembly 350 after it has been filled with the reinforcement material (hereinafter referred to as the reinforced cylindrical valve assembly 350'), and its large diameter valve 355 has been closed, resting on top of the reinforced cylindrical containment assembly 300'.

A riser assembly 125 may be attached between the large diameter valve 355 and a containment vessel on the ocean surface 105. The large diameter valve 355 may then be opened to allow the at least one of oil and gas 210 to be stored by the containment vessel.

The pressure of the at least one of oil or gas 210 may be monitored by the pressure monitor unit 388 after the large diameter valve 355 is closed. The large diameter valve 355 may be automatically opened by the pressure monitor unit 388 when the pressure within the reinforced cylindrical containment assembly 300' reaches or exceeds a predetermined threshold.

The wide hollow wall 305 of the reinforced cylindrical containment assembly 300' may be of such a large width (e.g., 10 feet or more), that it may be unlikely that the reinforced cylindrical containment assembly 300' would sink very far below the ocean floor 115, and thus the mud flaps 340 may not be necessary. However, the extreme weight applied to the top perimeter 328 (see FIG. 3D) of the wide hollow wall 305 of the reinforced cylindrical containment assembly 300' may be so great, that the reinforced cylindrical containment assembly 300' may sink many feet below the ocean floor 115. Thus, it is important to perform initial tests and analysis in a laboratory setting to determine more precise and optimal dimensions that may be applicable to a particular BOP stack failure situation.

Figure 4:
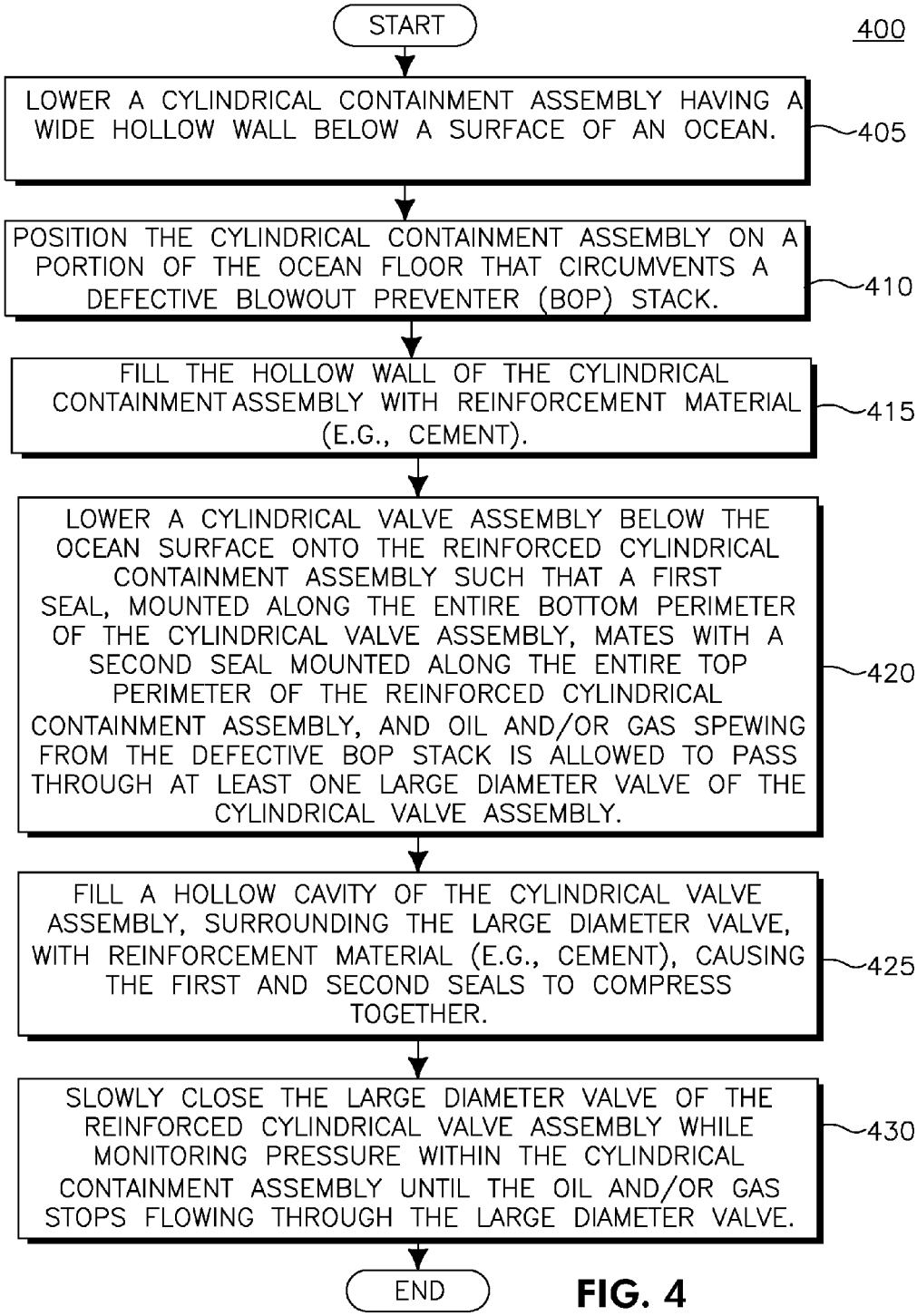
FIG. 4 is a flow diagram of a procedure for containing oil and/or gas spewing from a defective BOP stack using the cylindrical containment assembly of FIG. 3A and the cylindrical valve assembly of FIG. 3C in accordance with the first embodiment of the present invention.

FIG. 4 is a flow diagram of a procedure 400 for containing the oil and/or gas 210 spewing from the defective BOP stack 120' using the cylindrical containment assembly 300 of FIG. 3A and the cylindrical valve assembly 350 of FIG. 3C. As previously described, the cylindrical containment assembly 300 has a wide hollow wall 305 comprising an inner wall 315, an outer wall 320, an annular rim 380 connected between the bottom of the inner wall 315 and the bottom of the outer wall 320, and a reinforcement cavity 310 above the annular rim 380.

In step 405 of the procedure 400 of FIG. 4, the cylindrical containment assembly 300 is lowered below the ocean surface 105. In step 410, the annular rim 380 of the wide hollow wall 305 of the cylindrical containment assembly 300 is positioned on a portion 345 of the ocean floor 115 that circumvents the defective BOP stack 120'. In step 415, the reinforcement cavity 310 of the wide hollow wall 305 of the cylindrical containment assembly 300 is filled with reinforcement material (e.g., cement), optionally via one or more cement input valves 325.

In step 420 of the procedure 400 of FIG. 4, the cylindrical valve assembly 350 is lowered below the ocean surface 105 onto the reinforced cylindrical containment assembly 300' such that at least one first seal 360/365, mounted along the entire bottom perimeter 368 of the cylindrical valve assembly 350, mates with at least one second seal 330/335 mounted along the entire top perimeter 328 of the reinforced cylindrical containment assembly 300', and the oil and/or gas 210 spewing from the defective BOP stack 120' is allowed to pass through at least one large diameter valve 355 of the cylindrical valve assembly 350. In step 425, a hollow cavity 375 of the cylindrical valve assembly 350, surrounding the large diameter valve 355, is filled with reinforcement material (e.g., cement), causing the first seal 360/365 and the second seal 330/335 to compress together. In step 430, the large diameter valve 355 of the reinforced cylindrical valve assembly 350' is slowly closed, while using the pressure monitor unit 388 to monitor the pressure within the reinforced cylindrical containment assembly 300', until the oil and/or gas 210 stops flowing through the large diameter valve 355.

As an example, the diameter of the cylindrical containment assembly 300 may be on the order of 80 feet, and the height of the cylindrical containment assembly 300 may be on the order of 60 feet. The width of the hollow wall 305 of the cylindrical containment assembly 300 may be on the order of 10 feet. The diameter of the cylindrical valve assembly 350 may be equal to or greater than the diameter of the cylindrical containment assembly 300, and the height of the cylindrical valve assembly 350 may be on the order of 80 feet. Thus, the hollow cavity 375 of the of the cylindrical valve assembly 350 may be able to hold on the order of 400,000 cubic feet of reinforcement material (e.g., cement). Depending upon the type of reinforcement material used, which may range from 90 to 140 pounds per cubic foot, and how much is poured into the hollow cavity 375 of the cylindrical valve assembly 350, the weight applied to the top perimeter 328 of the reinforced cylindrical containment assembly 300' to counter the pressure of the spewing oil and/or gas 210 may be on the order of 25,000 tons. The enormous mass of the reinforced cylindrical valve assembly 350', combined with the large mass of the cement-filled reinforcement cavity 310 of the reinforced cylindrical containment assembly 300', should insure that the oil and/or gas 210 would not be able to pass through the bottom of the reinforced cylindrical containment assembly 300', since the annular rim 380 would be applying a huge force to the ocean floor 115, causing it to compress and form an watertight seal with the bottom of the reinforced cylindrical containment assembly 300'.

The diameter of the valve 355 is critical to the first embodiment of the present invention, and may be on the order of six feet. For example, the diameter of the valve 355 may be similar to the diameter of jet flow gates used for dams, such as the Hoover Dam, which may range in diameter from 68 to 90 inches. The valve 355 is designed to operate under high pressure (e.g., 10,000 pounds per square inch (PSI)), and may include a steel plate that may be opened or closed to either prevent or allow the spewing oil and/or gas 210 to be discharged.

As would be known by one of ordinary skill, smaller or larger dimensions may be applicable to the components used to implement the various embodiments of the present invention in accordance with the particular BOP failure situation that the assemblies 300 and 350 are designed for. For example, initial tests and analysis should be performed in a laboratory setting to determine more precise dimensions that may be applicable to a particular BOP stack failure situation.

The first embodiment of the present invention, as described above in conjunction with FIGS. 3A-3H and 4, may incorporate any of the features of the additional embodiments described below. For example, it may be desired to add top kill input valves to allow top kill cement to flow within the inner wall 315 of the cylindrical containment assembly 300, or to fasten a secondary containment assembly between the large diameter valve 355 of the cylindrical valve assembly 350 and at least one containment vessel on the ocean surface 105 to store the oil and/or gas 210. Although a cylindrical geometry has been proposed for the first embodiment of the present invention to minimize leakage of the spewing oil and/or gas 210 at joints (i.e., corners) of a containment system, any other geometric configuration may be used.

Figure 2:
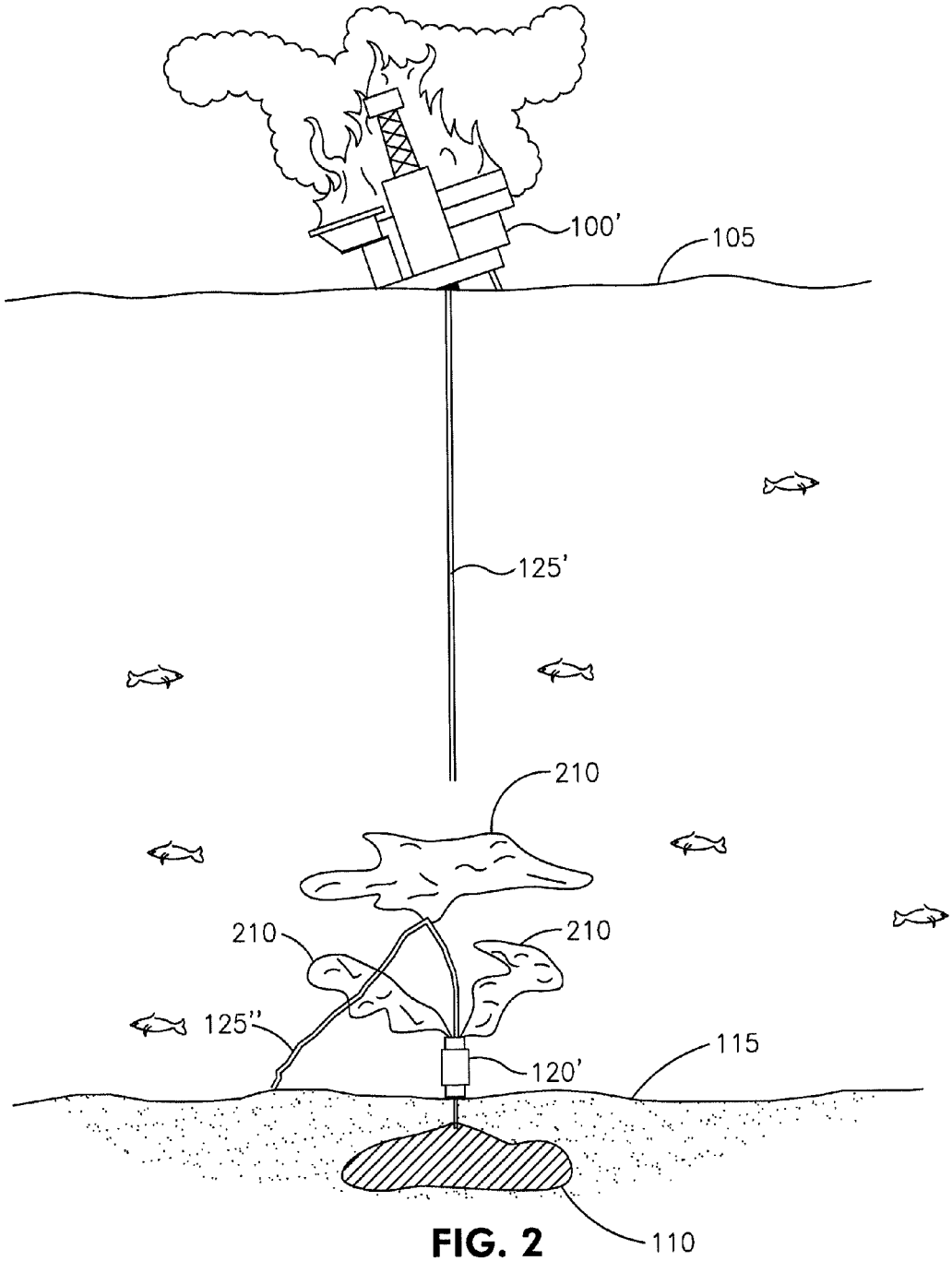
FIG. 2 PRIOR ART
FIG. 2 shows a deep sea drilling rig after exploding due to a defective BOP stack, and causing an oil and/or gas spill that needs to be contained.
Figure 5A:
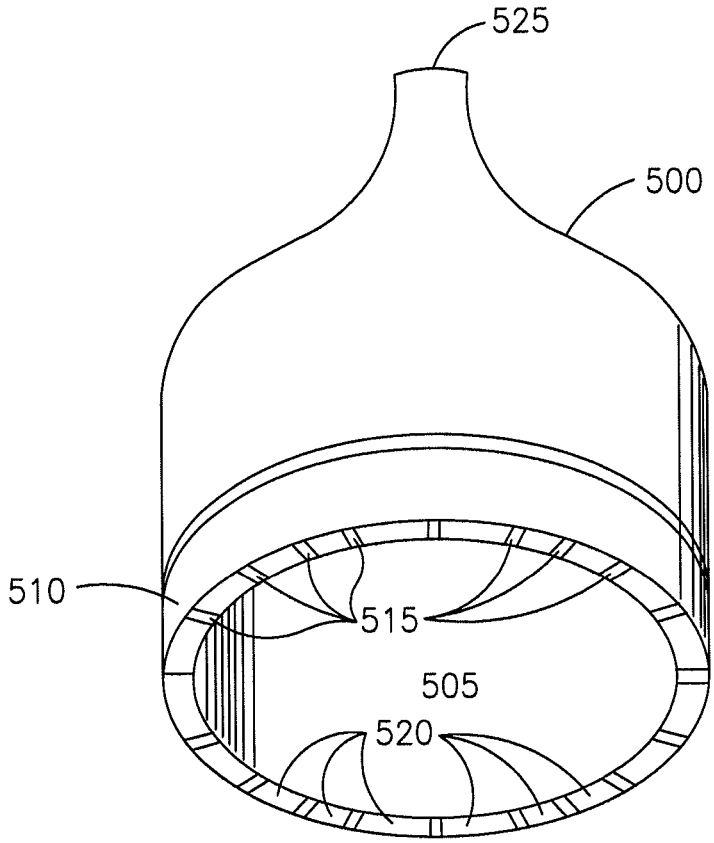
FIG. 5A shows a primary containment assembly including a self-fastening mechanism having fastening devices and sealing devices in accordance with a second embodiment of the present invention.

FIG. 5A shows a primary containment assembly 500 configured to circumvent the defective BOP stack 120' of FIG. 2 in accordance with a second embodiment of the present invention. The primary containment assembly 500 may be configured in a cylindrical or conical shape, but must be large enough to sufficiently circumvent the defective BOP stack 120'. The primary containment 500 may comprise a first opening 505 that circumvents the defective BOP stack 120'. The first opening 505 is preferably configured to be fastened and sealed to the ocean floor 115 by using, for example, a self-fastening mechanism 510 comprising fastening devices 515 and/or sealing devices 520.

Figure 5B:
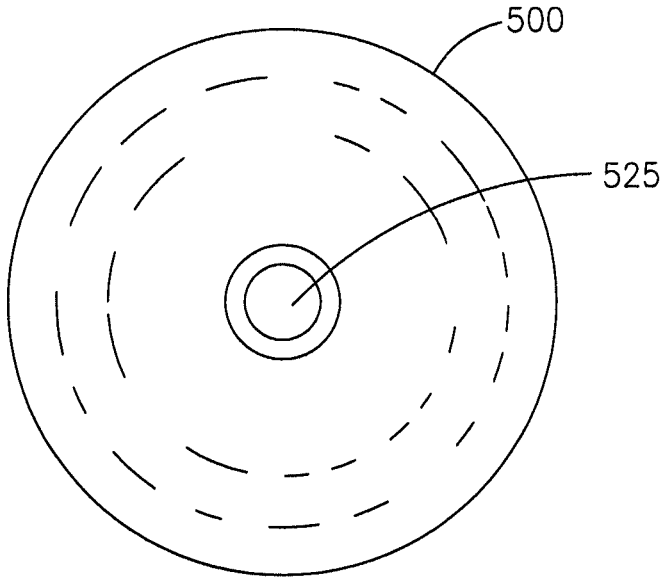
FIG. 5B shows a top view of the primary containment assembly of FIG. 5A.
Figure 5C:
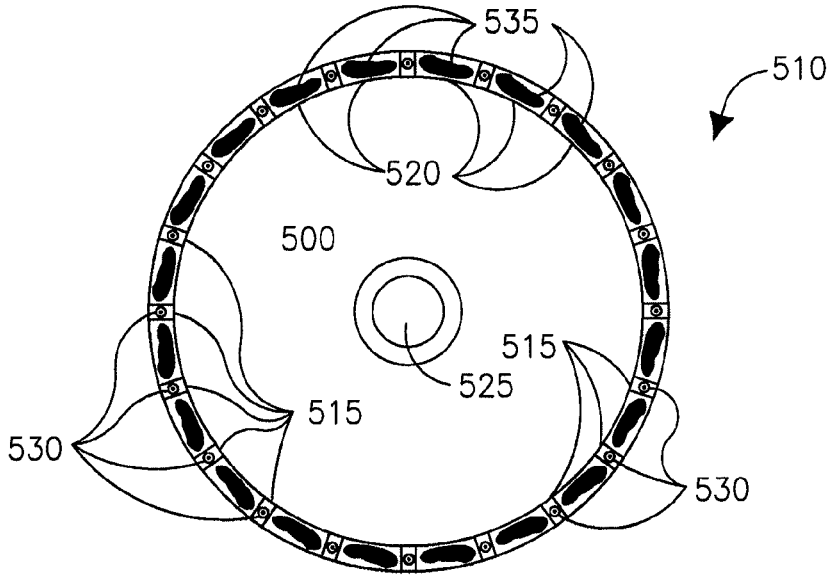
FIG. 5C shows a bottom view of the primary containment assembly of FIG. 5A including activated fastening devices and sealing devices.
Figure 5D:
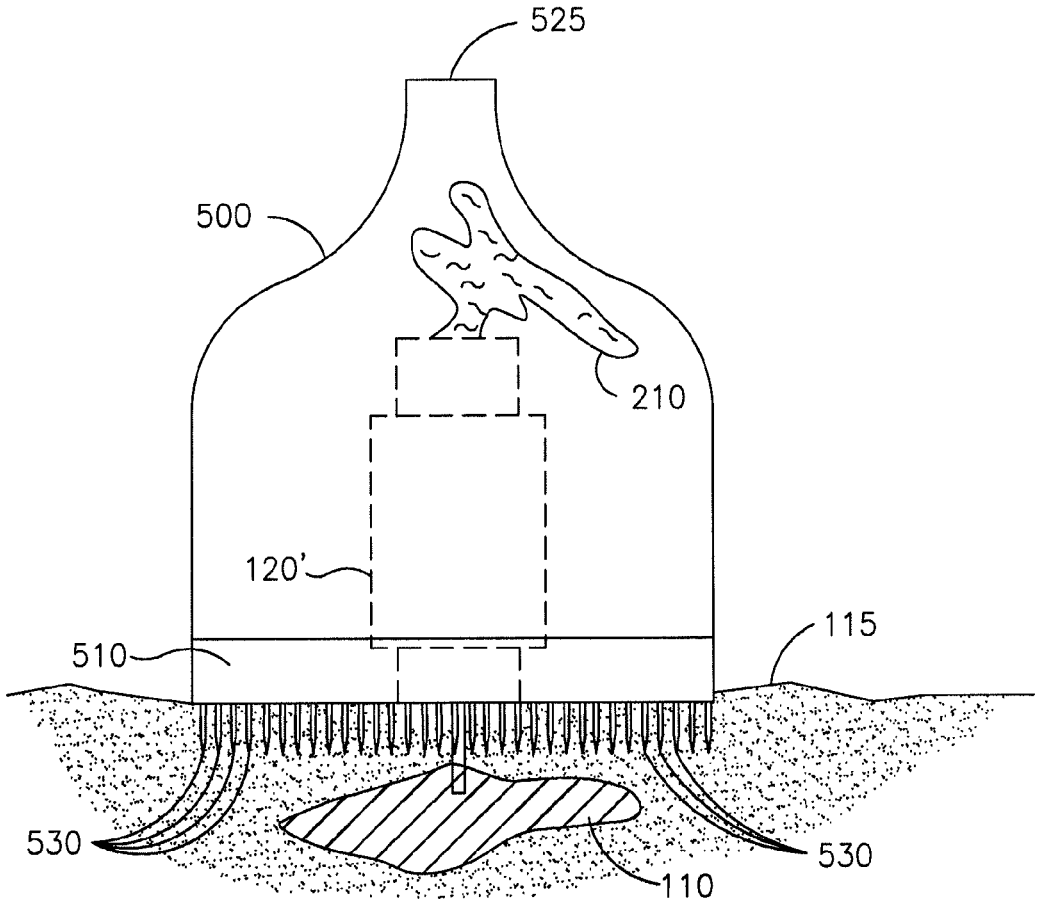
FIG. 5D shows a side view of the primary containment assembly of FIG. 5A circumventing the defective BOP stack and fastened to the ocean floor via the fastening elements of the self-fastening mechanism.
Figure 5E:
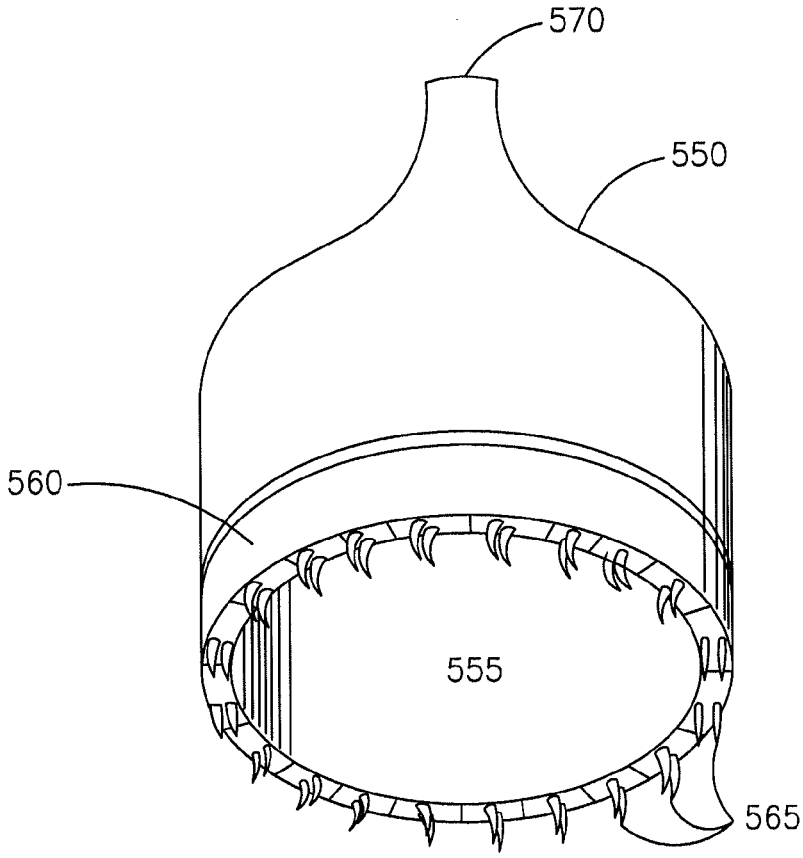
FIG. 5E shows a primary containment assembly including a self-fastening mechanism having a set of blades in accordance with an alternative to the second embodiment of the present invention.
Figure 5F:
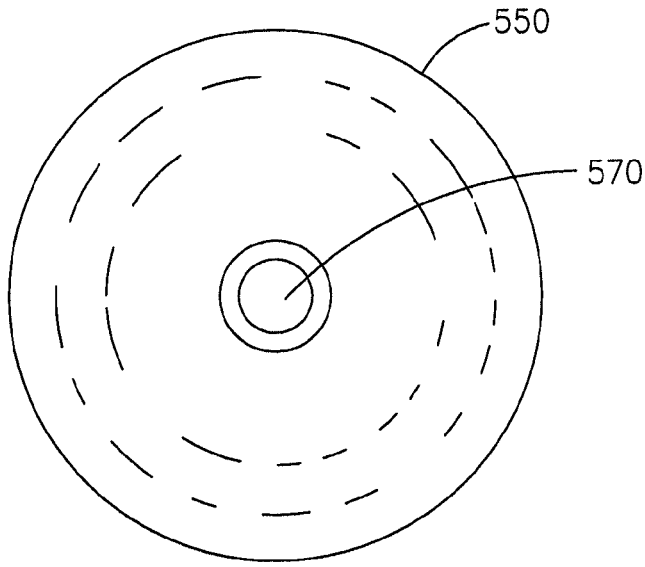
FIG. 5F shows a top view of the primary containment assembly of FIG. 5E.
Figure 5G:
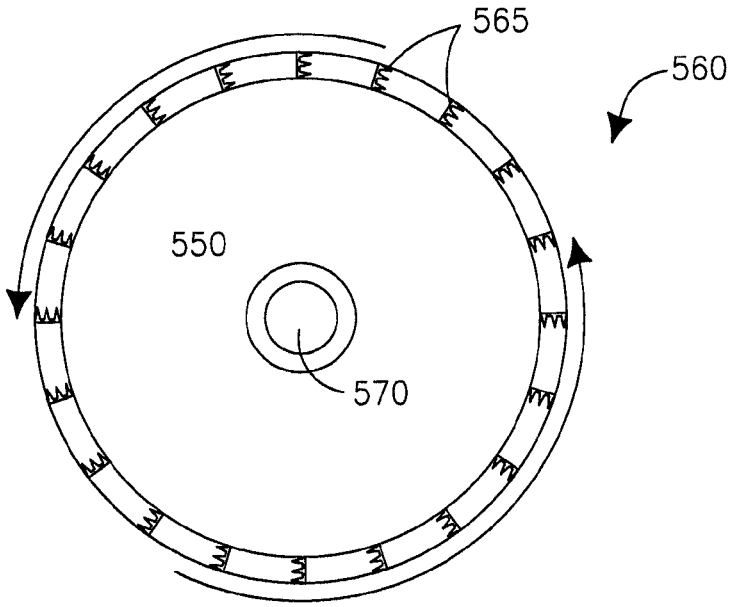
FIG. 5G shows a bottom view of the primary containment assembly of FIG. 5E with the blades of the self-fastening mechanism rotating.
Figure 5H:
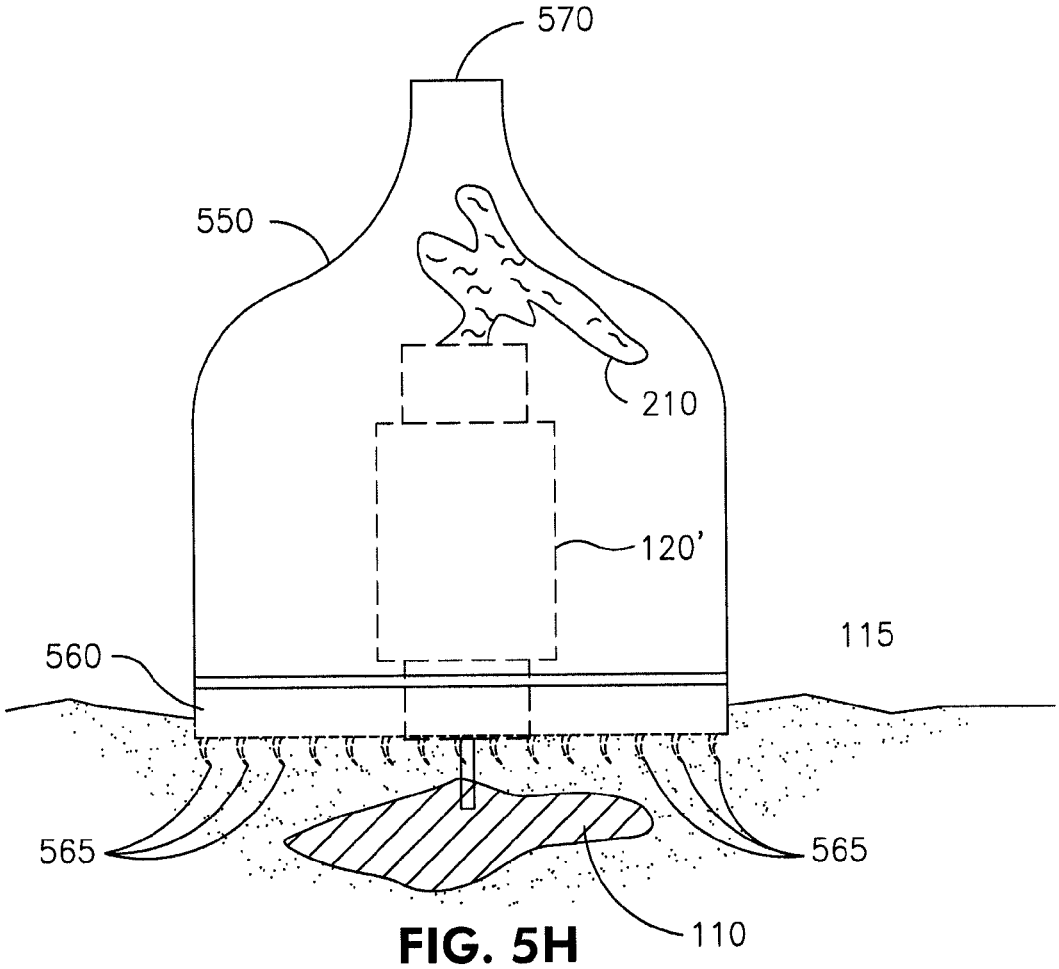
FIG. 5H shows a side view of the primary containment assembly of FIG. 5E circumventing the defective BOP stack and fastened to the ocean floor via the blades of the self-fastening mechanism.
Figure 5I:
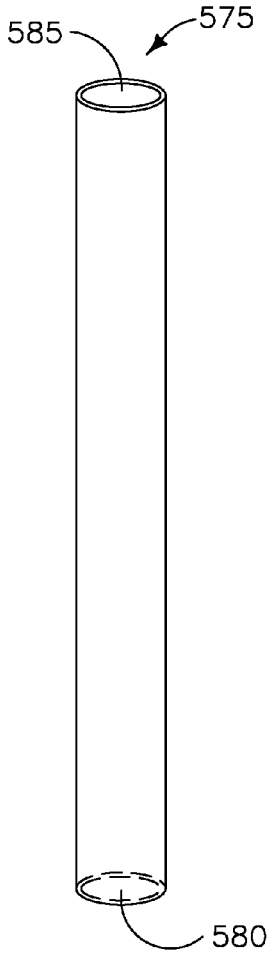
FIGS. 5I, 5J and 5K show examples of various secondary containment assemblies configured to be fastened between the primary containment assembly and at least one containment vessel floating on the ocean surface.
Figure 5J:
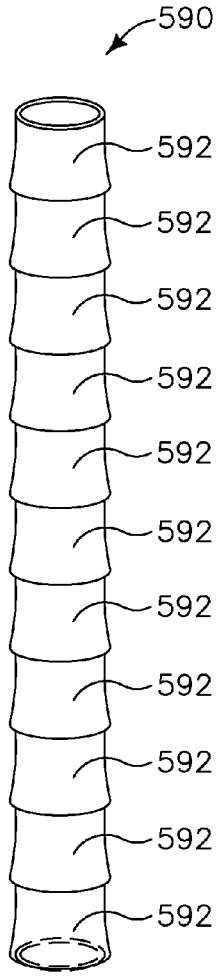
Figure 5K:
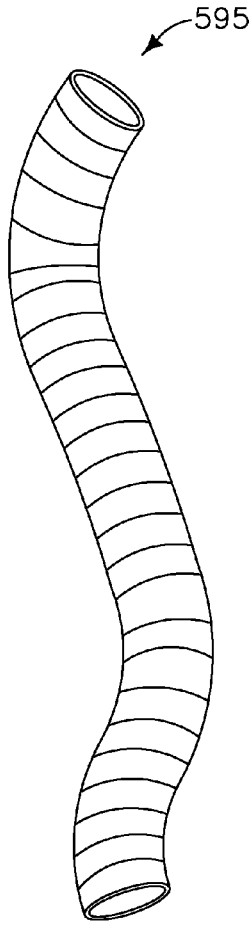

Still referring to FIG. 5A, the primary containment assembly 500 may further comprise a second opening 525 that is narrower than the first opening 505 and through which the spewing oil and/or gas 210 may rise to a secondary containment assembly (e.g., see FIGS. 5I, 5J and 5K).

FIG. 5B shows a top view of the primary containment assembly 500 of FIG. 5A including the second opening 525.

FIG. 5C shows a bottom view of the self-fastening mechanism 510 of the primary containment assembly 500 of FIG. 5A including activated fastening elements 530 projecting from the fastening devices 515, and sealant 535 released from the sealing devices 520. The self-fastening mechanism 510 may include a series of small explosive charges that, when detonated, force the fastening elements 530 to project from the fastening devices 515, and fasten the primary containment assembly 500 to the ocean floor 115. The self-fastening mechanism 510 may be activated to release sealant 535 that provides a water-tight seal between the primary containment assembly 500 and the ocean floor 115.

FIG. 5D shows a side view of the primary containment assembly 500 of FIG. 5A circumventing the defective BOP stack 120' and fastened to the ocean floor 115 via the fastening elements 530 of the self-fastening mechanism 510.

FIG. 5E shows a primary containment assembly 550 configured to circumvent the defective BOP stack 120' of FIG. 2 in accordance with an alternative to the second embodiment of the present invention. The primary containment assembly 550 may be configured in a cylindrical or conical shape, but must be large enough to sufficiently circumvent the defective BOP stack 120'. The primary containment 550 may comprise a first opening 555 that circumvents the defective BOP stack 120'. The first opening 555 is preferably configured to be fastened and sealed to the ocean floor 115 by using, for example, a self-fastening mechanism 560 that rotates at least one blade 565 used to burrow a portion of the primary containment assembly 550 below the ocean floor 115.

Still referring to FIG. 5E, the primary containment assembly 550 may further comprise a second opening 570 that is narrower than the first opening 555 and through which the spewing oil and/or gas 210 may rise to a secondary containment assembly (e.g., see FIGS. 5I, 5J and 5K).

FIG. 5F shows a top view of the primary containment assembly 550 of FIG. 5E including the second opening 570.

FIG. 5G shows a bottom view of the self-fastening mechanism 560 of the primary containment assembly 550 of FIG. 5E including at least one rotating blade 565 of the self-fastening mechanism 560.

FIG. 5H shows a side view of the primary containment assembly 550 of FIG. 5E circumventing the defective BOP stack 120' and fastened to the ocean floor 115 via the blade(s) 565 of the self-fastening mechanism 560.

The primary containment assembly 500/550 is lowered below the ocean surface 105 and positioned on a portion of the ocean floor 115 that circumvents the defective BOP stack 120'. Although it may be possible to lower the primary containment assembly 500/550 over the defective BOP stack 120' if the riser assembly 125 remains in a vertical position by letting the riser assembly 125 pass through the first opening 505/555 and the second opening 525/570 of the primary containment assembly 500/550, the riser assembly 125 needs to be disconnected (i.e., cut off) near the top of the defective BOP stack 120' if a catastrophic event caused the riser assembly 125 to collapse (i.e., fold over), as what occurred due to the Deepwater Horizon drilling rig explosion.

Preferably, it would be desirable to grade the portion of the ocean floor 115 that circumvents the defective BOP stack 120' before the primary containment assembly 500/550 is positioned, in order to optimize the reduction of the pollution of the ocean caused by the oil and/or gas 210 spewing from the defective BOP stack 120'. Such ocean floor grading may be performed by at least one ROV. Furthermore, the ROV may be used to assist in the lowering and positioning of the primary containment assembly 500/550.

Alternatively, the primary containment assembly 500/550 may consist of a plurality of sections and/or components that are assembled below the ocean surface 105. The sections and/or components of the primary containment assembly 500/550 would be constructed and stored onshore close to areas where deepwater rigs are active. The sections and/or components may include seals and/or gaskets, and the sections and/or components may be assembled together as they are immersed just under the ocean surface 105.

Figure 1:
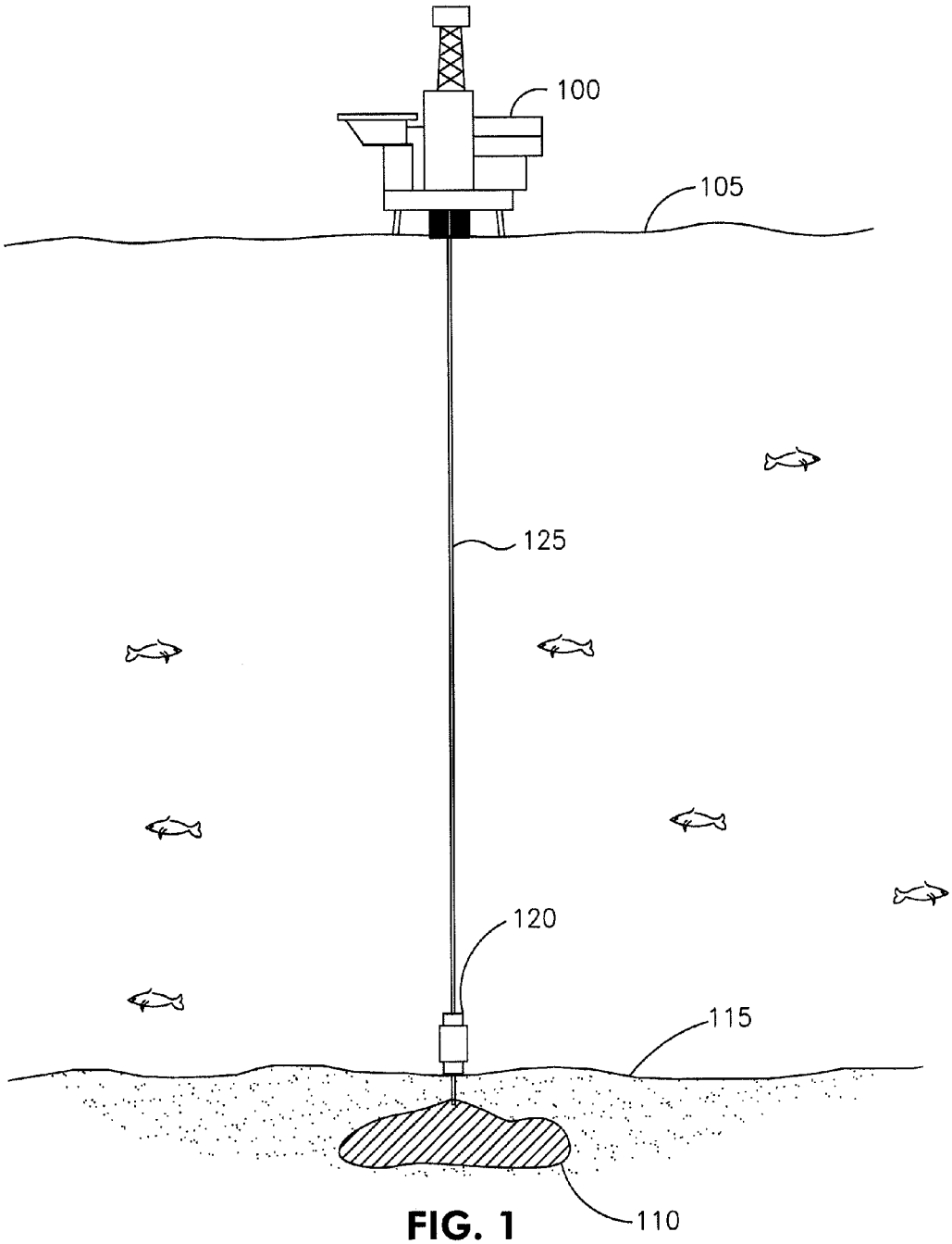
FIG. 1 PRIOR ART
FIG. 1 shows a simplified diagram of a deep sea drilling rig on a surface of an ocean that processes oil and/or gas received from a BOP stack located on a floor of the ocean.

FIG. 5I shows a secondary containment assembly 575 configured to be fastened between the primary containment assembly 500/550 at the second opening 525/570 and at least one containment vessel floating on the ocean surface 105 in accordance with the second embodiment of the present invention. The secondary containment assembly 575 may be similar to a riser assembly 125 that is typically connected directly to a properly operating BOP stack 120, as shown in FIG. 1, but instead of being attached to the BOP stack 120, a first opening 580 of the secondary containment assembly 575 is directly attached to the second opening 525/570 of the primary containment assembly 500/550, and a second opening 585 of the secondary containment assembly 575 is either directly or indirectly attached to at least one containment vessel floating on the ocean surface 105 to allow the spewing oil and/or gas 210 to rise from the second opening 525/570 of the primary containment assembly 500/550 to the containment vessel. The secondary containment assembly 575 is preferably configured in a cylindrical shape, but must be long enough to reach the ocean surface 105.

FIG. 5J shows a secondary containment assembly 590 configured to be fastened between the primary containment assembly 500/550 at the second opening 525/570 and at least one containment vessel floating. The secondary containment assembly 590 comprises a plurality of sections 592 that are interconnected to allow the spewing oil and/or gas 210 to rise from the second opening 525/570 of the primary containment assembly 500/550 to at least one containment vessel floating on the ocean surface 105. The sections 592 may be identical, or have varying lengths, but are all preferably configured in a cylindrical shape that, after being interconnected, are long enough to reach the ocean surface 105.

FIG. 5K shows a secondary containment assembly 595 configured to be fastened between the primary containment assembly 500/550 at the second opening 525/570 and at least one containment vessel floating on the ocean surface 105. The secondary containment assembly 595 may comprise a flexible ducting hose, or a plurality of flexible ducting hose sections that are connected in a similar fashion as the sections 592 of the secondary containment assembly 590 of FIG. 5J.

Figure 6A:
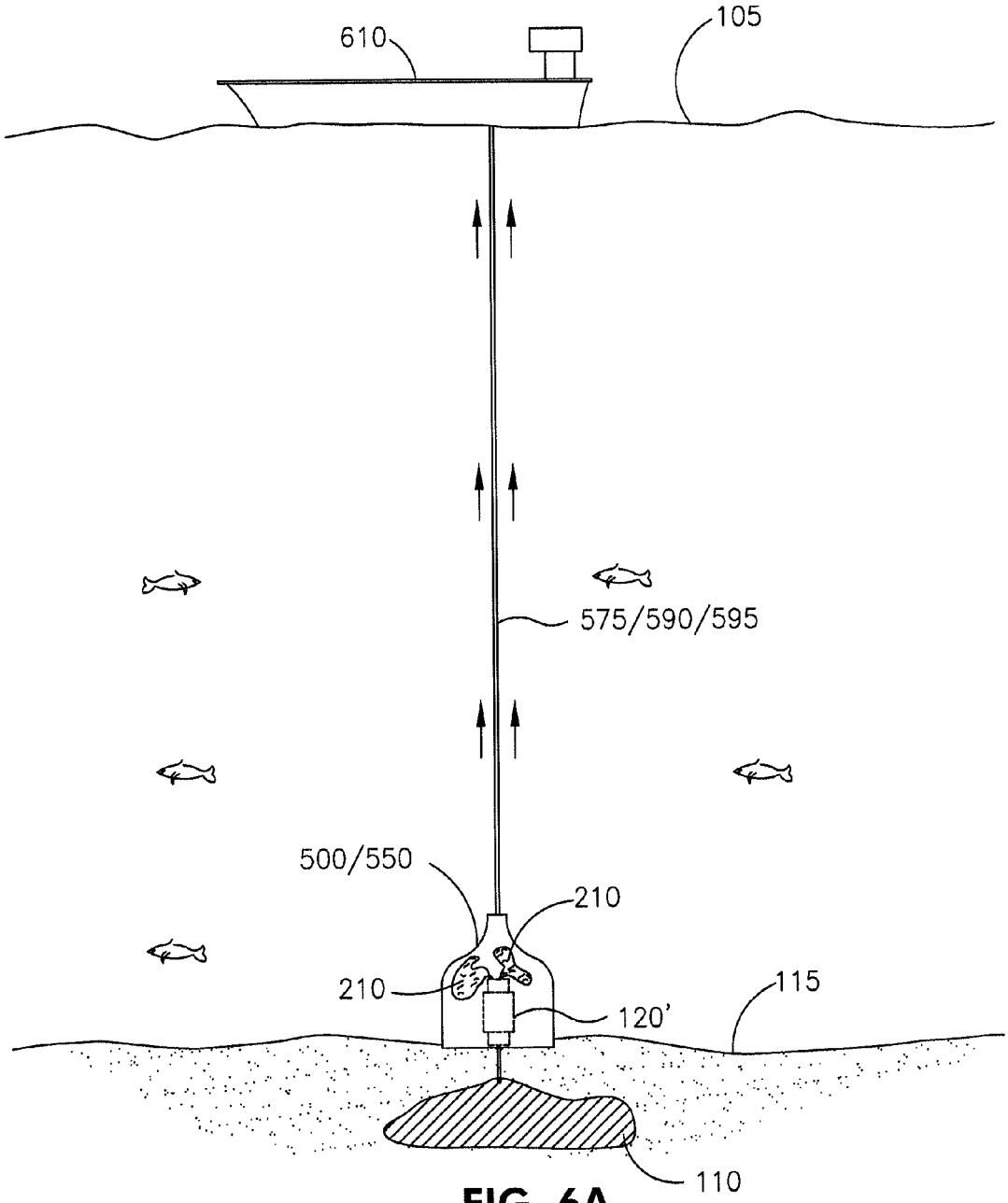
FIG. 6A shows a side view of the assembled first and second containment assemblies connected between the ocean floor and a containment vessel.

FIG. 6A shows a side view of the assembled first and second containment assemblies 500/550/575/590/595 connected between the ocean floor 115 and a containment vessel 610.

Figure 6B:
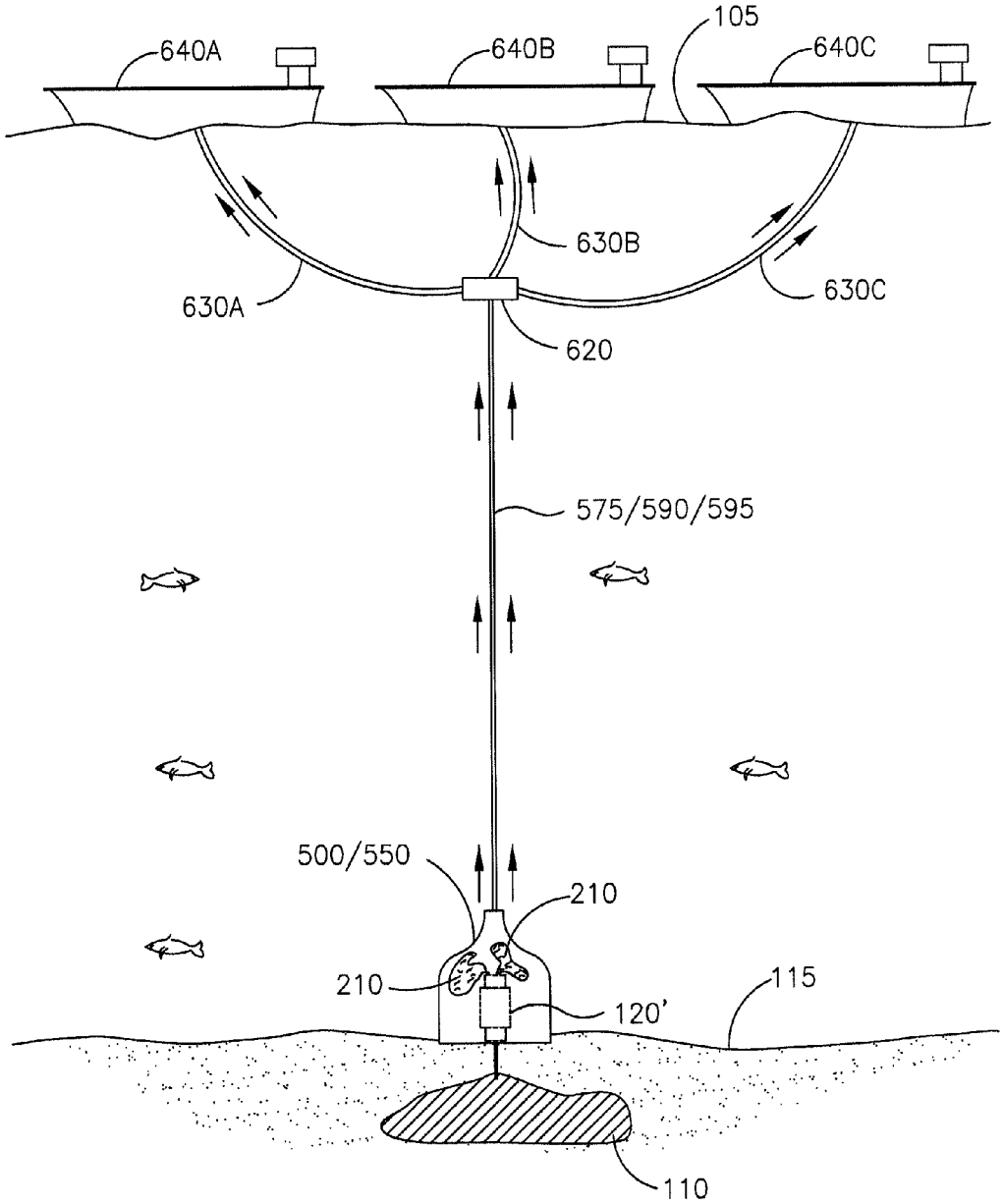
FIG. 6B shows a side view of assembled first and second containment assemblies connected between the ocean floor and an oil and/or gas routing device that is controlled to allow the oil and/or gas to be routed via one or more flexible containment sections in order to be stored by one or more respective containment vessels.

FIG. 6B shows a side view of the assembled first and second containment assemblies 500/550/575/590/595 connected between the ocean floor 115 and an oil and/or gas routing device 620 that is controlled to allow the oil and/or gas to be routed via one or more flexible containment sections (i.e., sections of flexible ducting hose) 630A, 630B and 630C in order to be stored by one or more respective containment vessels 640A, 640B and 640C. By using the flexible containment sections 630A, 630B and 630C, the containment vessels are free to move relative to the routing device 620 due to the influence of tides, currents and weather. Oil would either be pumped to the containment vessels or rise naturally from the routing device due to its own buoyancy.

Figure 7:
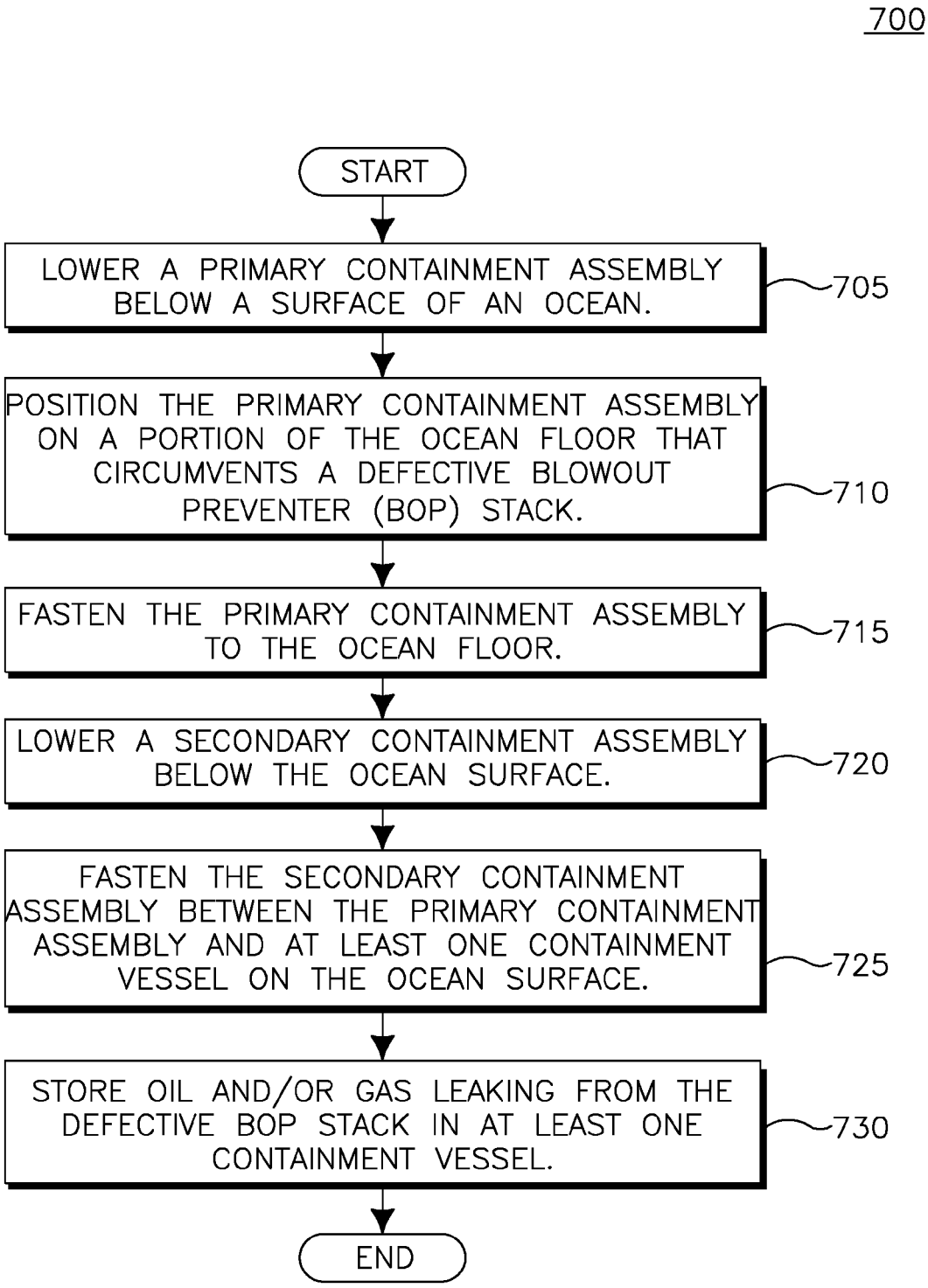
FIG. 7 is a flow diagram of a procedure for containing oil and/or gas spewing from a defective BOP stack using the primary and secondary containment assemblies of FIGS. 5A-5K.

FIG. 7 is a flow diagram of a procedure 700 for containing oil and/or gas spewing from a defective BOP stack 120' located on an ocean floor 115 and causing pollution to the ocean. In step 705, a primary containment assembly 500/550 is lowered below the ocean surface 105. In step 710, the primary containment assembly 500/550 is positioned on a portion of the ocean floor 115 that circumvents the defective BOP stack 120'. In step 715, the primary containment assembly 500/550 is fastened to the ocean floor 115. In step 720, a secondary containment assembly 575/590/595 is lowered below the ocean surface 105. In step 725, the secondary containment assembly 575/590/595 is fastened between the primary containment assembly 500/550 and at least one containment vessel 610/640 on the ocean surface 105. One or more of steps 705, 710, 715, 720 and 725 may be performed by at least one ROV. In step 730, the oil and/or gas 210 spewing from the defective BOP stack 120' is stored in the at least one containment vessel 610/640.

Figure 8A:
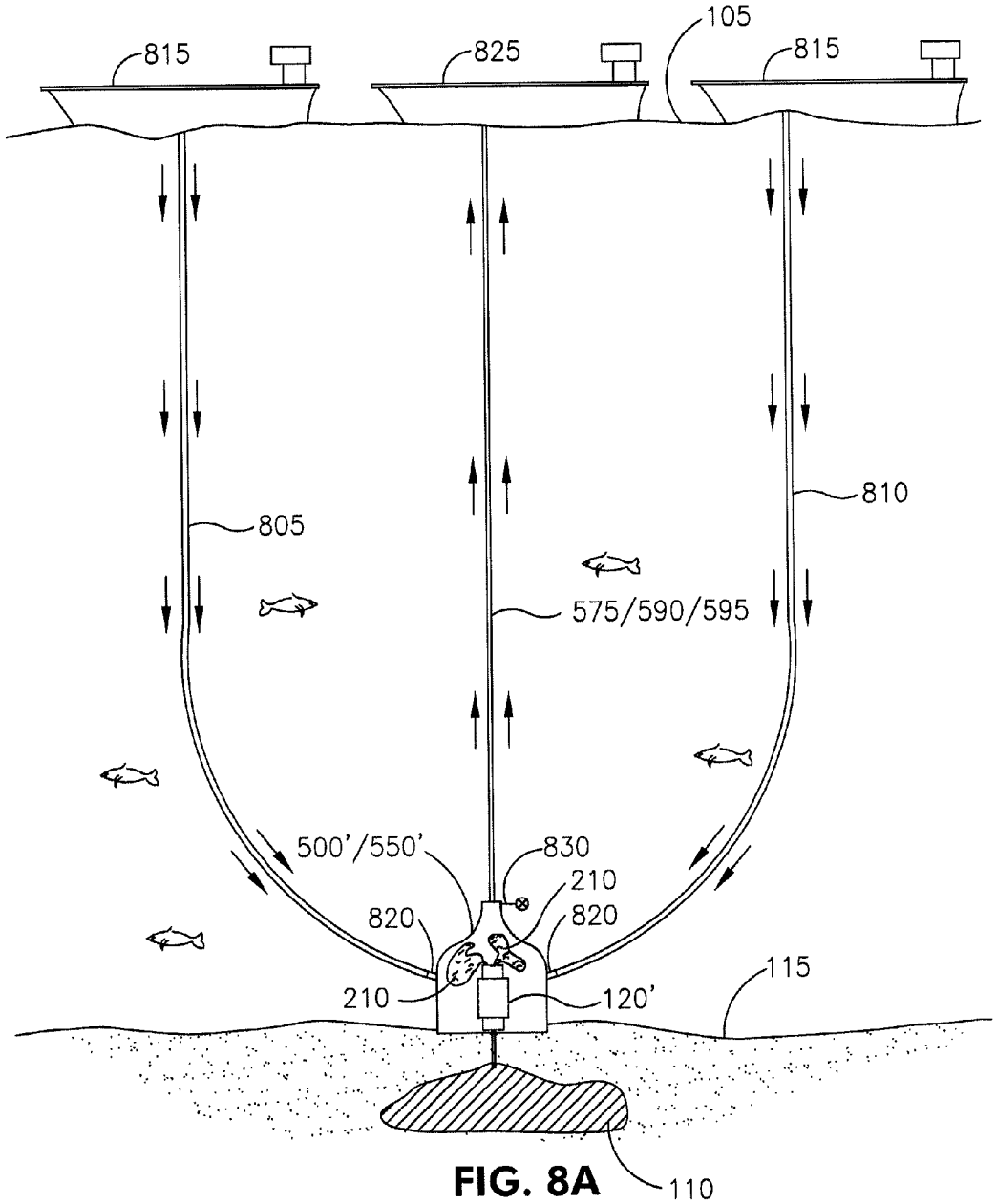
FIG. 8A shows a side view of a primary containment assembly configured to receive "top kill" cement and/or mud via a first set of top kill valves, while regulating the output of the leaking oil and/or gas via a valve on an upper opening in accordance with a third embodiment of the present invention.

FIG. 8A shows a side view of a primary containment assembly 500' or 550' configured to receive top kill cement and/or mud 805/810 from vessels 815 via a first set of top kill input valves 820, while regulating the output of the leaking oil and/or gas being contained by a containment vessel 825 via a large diameter valve 830 mounted on an upper opening of the primary containment assembly 500' or 550' in accordance with a third embodiment of the present invention. Thus, the entire defective BOP stack 120' is submerged in the cement and/or mud 805/810, which is contained within the walls of the primary containment assembly 500' or 550'. Assuming that the primary containment assembly 500' or 550' is of sufficient size and thickness, as could be determined in a laboratory setting, the underground well for which the defective BOP stack 120' was designed to control, should stop spewing the oil and/or gas 210 due to being completely surrounded in a deep layer of the cement and/or mud 805/810 that is sufficiently contained. Preferably, the valve 830 may be configured to be remotely controlled (either wirelessly or via a wired or hydraulic connection from a vessel on the ocean surface 105) to maintain an open position, a partially open position or a closed position, as desired.

Figure 8B:
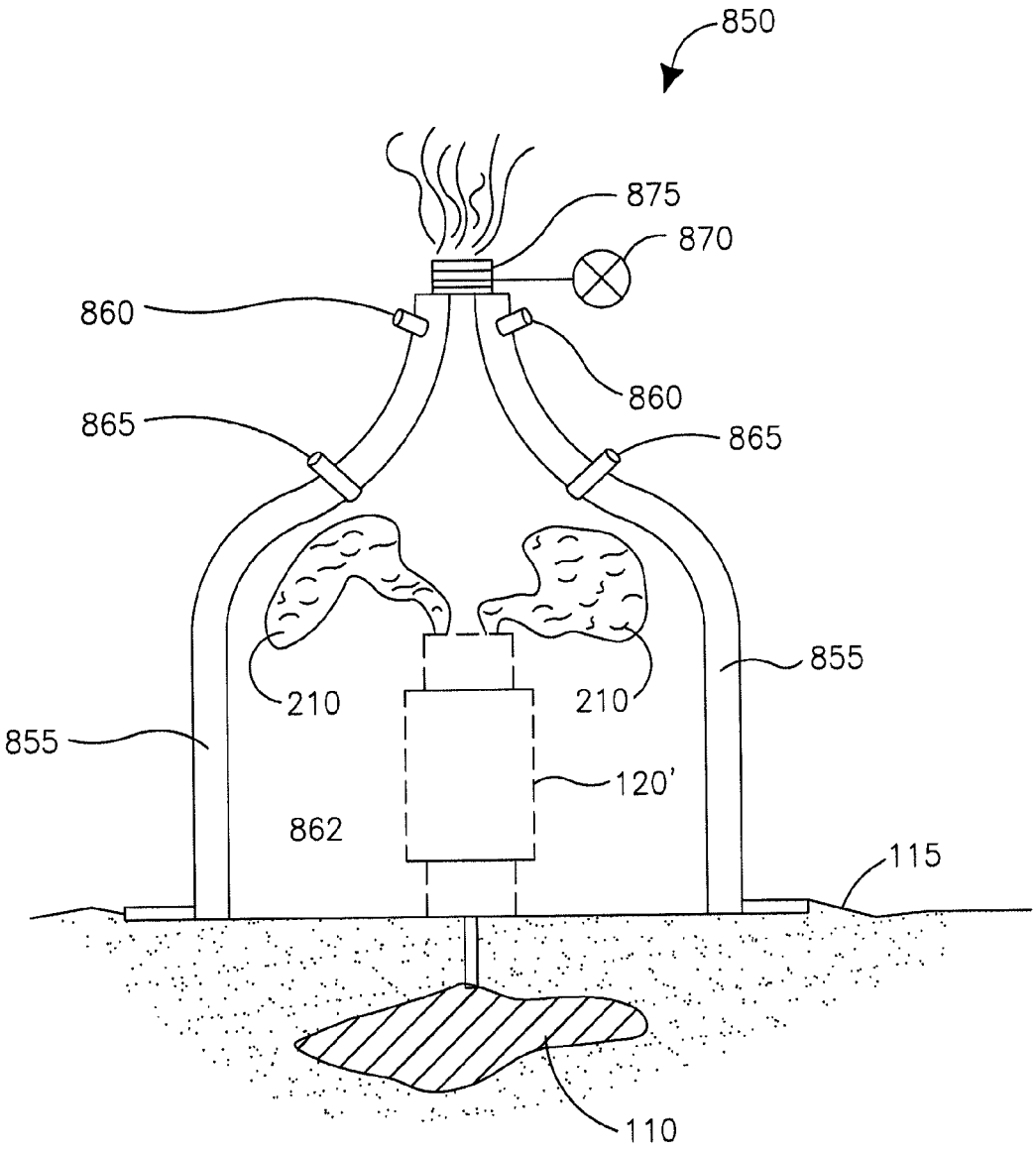
FIG. 8B shows a side view of a primary containment assembly having a hollow steel-reinforced wall configured to receive wall reinforcement material via a set of wall reinforcement valves, and a second set of top kill valves configured to receive top kill cement and/or mud to fill a bottom portion of the primary containment assembly, while regulating the output of the leaking oil and/or gas via a valve on a heated upper opening in accordance with a fourth embodiment of the present invention.

In accordance with a fourth embodiment of the present invention, FIG. 8B shows a side view of a primary containment assembly 850 having a hollow steel-reinforced wall 855 configured to contain reinforcement material (e.g., cement) received via a set of wall reinforcement input valves 860, and a hollow cavity 862 configured to contain reinforcement material (e.g., top kill cement) received via a second set of top kill input valves 865 configured to receive top kill cement and/or mud to fill a bottom portion of the primary containment assembly 850, while regulating the output of the spewing oil and/or gas 210 via a large diameter valve 870 mounted on an upper opening of the primary containment assembly 850 that, optionally, may be heated by one or more heating elements 875. Preferably, the large diameter valve 870 may be configured to be remotely controlled (either wirelessly or via a wired or hydraulic connection from a vessel on the ocean surface 105) to maintain an open position, a partially open position or a closed position, as desired.

Figure 9:
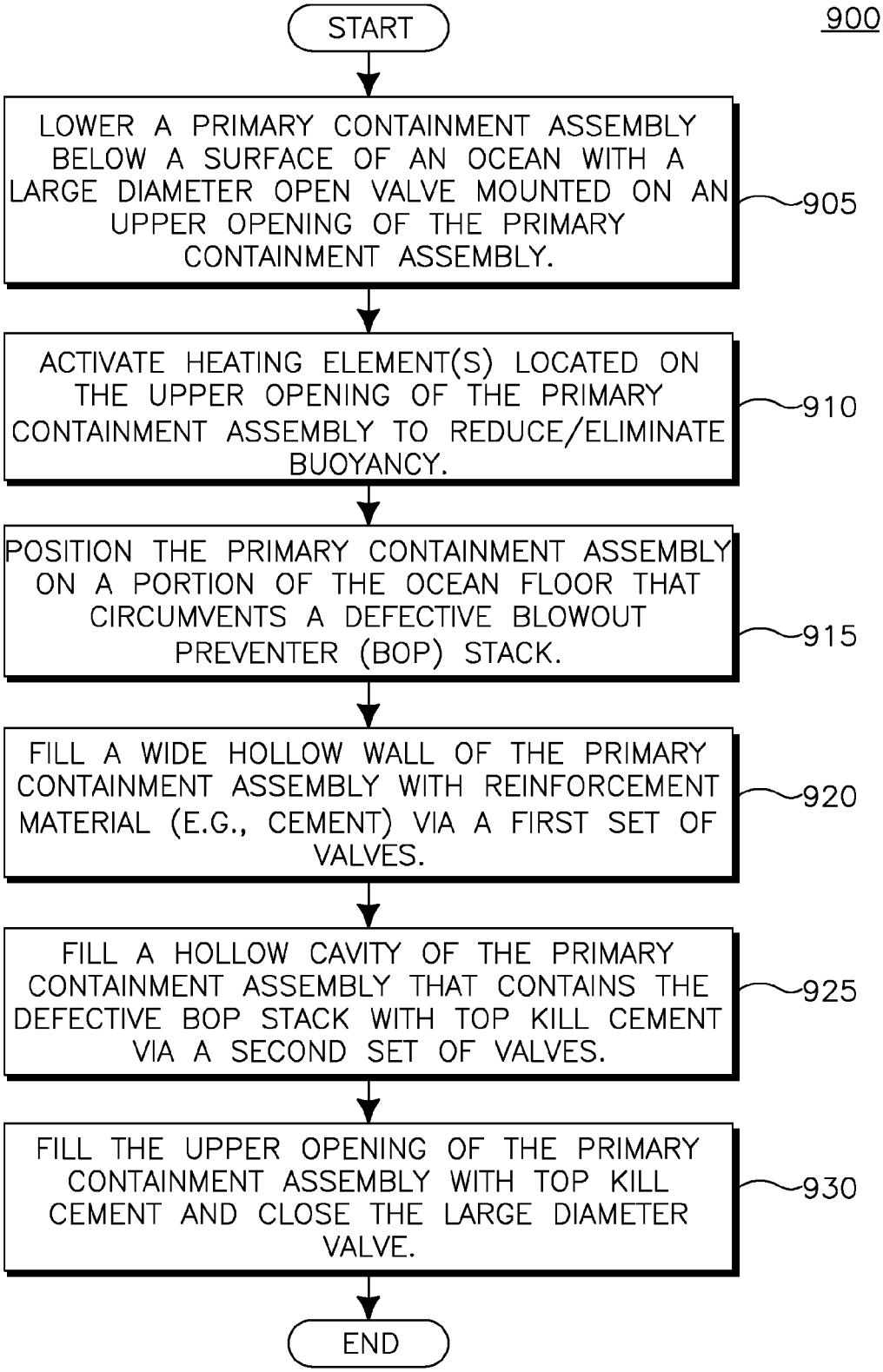
FIG. 9 is a flow diagram of a procedure for containing oil and/or gas spewing from a defective BOP stack using the primary containment assembly of FIG. 8B.

FIG. 9 is a flow diagram of a procedure 900 for containing oil and/or gas 210 spewing from a defective BOP stack 120' using the primary containment assembly 850 of FIG. 8B. In step 905, the primary containment assembly 850 is lowered below the ocean surface 105 with the large diameter valve 870 maintained in an open position. In step 910, the heating element(s) 875 is activated to reduce/eliminate buoyancy problems that may be caused by the spewing oil and/or gas 210. Furthermore, in its open position, the valve 870 is configured with an opening of such a large diameter that the oil and/or gas 210 would pass through it without being sufficiently impeded by ice-like crystals (i.e., icy hydrates) that may form near the bottom of an ocean. However, the heating element(s) 875 is used to insure that this is the case. In step 915, the primary containment assembly 850 is positioned on a portion of the ocean floor 115 that circumvents the defective BOP stack 120'. As previously described, the primary containment assembly 850 has a wide hollow steel-reinforced wall 855. In step 920, the hollow steel-reinforced wall 855 of the primary containment assembly 850 is filled with reinforcement material (e.g., cement) via wall reinforcement input valves 860. In step 925, a hollow inner cavity 862 of the primary containment assembly 855, in which the defective BOP stack 120' resides, is filled with reinforcement material (e.g., top kill cement) via a second set of top kill input valves 865. Finally, in step 930, the upper opening of the primary containment assembly 850 is filled with top kill cement and the valve 870 is then closed.

What is claimed is:

1. A method of containing an oil spill caused by a subsea blowout comprising positioning a cylindrical containment assembly such that a wall of the cylindrical containment assembly circumvents a portion of a floor of an ocean where the subsea blowout occurred, and activating at least one mud flap to selectively protrude from the wall or retract into the wall to control the depth that the cylindrical containment assembly sinks to below the ocean floor.

2. The method of claim 1 wherein the wall of the cylindrical containment assembly circumvents a blowout preventer (BOP).

3. Apparatus for containing an oil spill caused by a subsea blowout comprising a containment assembly configured to be positioned such that a wall of the containment assembly circumvents a portion of a floor of an ocean where the subsea blowout occurred, wherein at least one mud flap is activated to selectively protrude from the wall or retract into the wall to control the depth that the containment assembly sinks to below the ocean floor.

4. The apparatus of claim 3 wherein the wall of the containment assembly circumvents a blowout preventer (BOP).

5. A method of encasing a blowout preventer (BOP) located on a floor of an ocean comprising positioning a containment assembly such that a wall of the containment assembly circumvents the BOP, and activating at least one mud flap to selectively protrude from the wall or retract into the wall to control the depth that the containment assembly sinks to below the ocean floor.

6. A method of containing an oil spill comprising positioning a containment assembly such that a wall of the containment assembly circumvents a source of the oil spill located on a floor of an ocean, and activating at least one mud flap to selectively protrude from the wall or retract into the wall to control the depth that the containment assembly sinks to below the ocean floor.

7. The method of claim 6 wherein the source is a blowout preventer (BOP).

8. A method of encasing a source of pollution located on a floor of an ocean comprising positioning a containment wall to circumvent the source of pollution, and activating at least one mud flap to selectively protrude from the wall or retract into the wall to control the depth that the wall sinks to below the ocean floor.

9. The method of claim 8 wherein the source is a blowout preventer (BOP) and the pollution includes at least one of oil or gas.

10. A method of containing an oil spill caused by a subsea blowout comprising circumventing a blowout preventer (BOP), located on a floor of an ocean, with a wall of a containment assembly, and activating at least one mud flap to selectively protrude from the wall or retract into the wall to control the depth that the containment assembly sinks to below the ocean floor.

11. Apparatus for containing an oil spill caused by a subsea blowout, the apparatus comprising:

a wall of a cylindrical containment assembly configured to circumvent a blowout preventer (BOP), located on a floor of an ocean; and at least one mud flap configured to selectively protrude from the wall or retract into the wall when activated to control the depth that the containment assembly sinks to below the ocean floor.

* * * * *